US009096085B2

(12) United States Patent
Koga et al.

(10) Patent No.: US 9,096,085 B2
(45) Date of Patent: Aug. 4, 2015

(54) PRINTER WITH FORCE TRANSMITTING PATH SELECTING MECHANISM

(71) Applicants: Yuji Koga, Nagoya (JP); Masatoshi Izuchi, Nagoya (JP)

(72) Inventors: Yuji Koga, Nagoya (JP); Masatoshi Izuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/276,655

(22) Filed: May 13, 2014

(65) Prior Publication Data

US 2014/0247306 A1 Sep. 4, 2014

Related U.S. Application Data

(60) Continuation of application No. 13/852,768, filed on Mar. 28, 2013, now Pat. No. 8,727,648, which is a continuation of application No. 13/101,111, filed on May 4, 2011, now Pat. No. 8,475,067, which is a division of application No. 11/513,179, filed on Aug. 31, 2006, now Pat. No. 7,995,012.

(30) Foreign Application Priority Data

Aug. 31, 2005 (JP) ..... 2005-252136
Sep. 29, 2005 (JP) ..... 2005-285287
Sep. 30, 2005 (JP) ..... 2005-286155

(51) Int. Cl.
*B41J 19/00* (2006.01)
*B41J 23/04* (2006.01)
(Continued)

(52) U.S. Cl.
CPC ..... *B41J 19/202* (2013.01); *B41J 11/485* (2013.01); *B41J 13/009* (2013.01); *B41J 13/0018* (2013.01); *B41J 2/01* (2013.01); *B41J 25/001* (2013.01)

(58) Field of Classification Search
CPC ..... B41J 2/01; B41J 11/22; B41J 11/02; B41J 11/485; B41J 15/08–15/12; B41J 13/0018; B41J 13/009; B41J 25/001
USPC ..... 400/283, 319, 320, 337; 271/114; 347/104
IPC ..... B41J 19/00,13/009, 13/0018, 11/485
See application file for complete search history.

(56) References Cited

U.S. PATENT DOCUMENTS 4,978,112 A 12/1990 Yokoi
5,085,515 A 2/1992 Itoh et al.
(Continued)

FOREIGN PATENT DOCUMENTS

JP H02-103041 U 8/1990
JP H04-333438 A 11/1992
(Continued)

OTHER PUBLICATIONS

European Patent Office, European Search Report for European Patent Application No. 06018215 (counterpart to U.S. Patent No. 7,955,012 B2), dated Dec. 4, 2006.
(Continued)

*Primary Examiner* — Blake A Tankersley
*Assistant Examiner* — Marissa Ferguson Samreth
(74) *Attorney, Agent, or Firm* — Baker Botts L.L.P.

(57) ABSTRACT

A printer has a carriage being movable between a first end and a second end of a reciprocating path; and a driving force transmitting path selecting mechanism provided at the second end of the reciprocating path. The selecting mechanism has: a common driving force outputting member; a plurality of force receiving members; a selecting member; and a position retainer for keeping the position of the selecting member. The selecting member connects the force outputting member to one of the plurality of force receiving members, and moves in association with the carriage when the carriage moves in a vicinity of the second end in a first direction extending from the first end to the second end. The position retainer keeps the position of the selecting member when the carriage moves in a second direction extending from the second end to the first end. The force receiving member connected to the force outputting member via the selecting member is selected in accordance with a movement of the carriage along the reciprocating path.

13 Claims, 26 Drawing Sheets

(51) Int. Cl.

| | |
|---|---|
| ***B41J 9/14*** | (2006.01) |
| ***B41J 13/00*** | (2006.01) |
| ***B41J 19/20*** | (2006.01) |
| ***B41J 11/48*** | (2006.01) |
| *B41J 2/01* | (2006.01) |
| *B41J 25/00* | (2006.01) |

(56) References Cited

U.S. PATENT DOCUMENTS

| | | | |
|---|---|---|---|
| 5,841,450 | A | 11/1998 | Kawamura |
| 5,926,193 | A | 7/1999 | Umeda |
| 5,954,326 | A | 9/1999 | Gaarder et al. |
| 7,036,813 | B2 | 5/2006 | Asada |
| 2006/0071389 | A1 | 4/2006 | Kozaki et al. |
| 2007/0057447 | A1 | 3/2007 | Asada et al. |
| 2007/0231044 | A1 | 10/2007 | Koga et al. |

FOREIGN PATENT DOCUMENTS

| | | | |
|---|---|---|---|
| JP | H05-301394 | A | 11/1993 |
| JP | H07-081175 | A | 3/1995 |
| JP | H08-174958 | A | 7/1996 |
| JP | H09-141967 | A | 6/1997 |
| JP | 2000-159392 | A | 6/2000 |
| JP | 2001-058742 | A | 3/2001 |
| JP | 2002-104697 | A | 4/2002 |
| JP | 2002-154682 | A | 5/2002 |
| JP | 2002-167062 | A | 6/2002 |
| JP | 2002-283637 | A | 10/2002 |
| JP | 2003-089244 | A | 3/2003 |
| JP | 2004-090550 | A | 3/2004 |
| JP | 2005-060026 | A | 3/2005 |

OTHER PUBLICATIONS

Japan Patent Office, Notice of Reasons for Rejection for Japanese Patent Application No. 2005-286155 (counterpart to U.S. Patent No. 7,955,012 B2), mailed Jun. 25, 2008.

Japan Patent Office, Notification of Reasons for Rejection for Japanese Patent Application No. 2005-286155 (counterpart to U.S. Patent No. 7,955,012 B2), mailed Nov. 5, 2008.

Japan Patent Office, Notification of Reasons for Rejection for Japanese Patent Application No. 2005-285287 (counterpart to U.S. Patent No. 7,955,012 B2), mailed Dec. 3, 2008.

Japan Patent Office, Notification of Reasons for Rejection for Japanese Patent Application No. 2006-235098 (counterpart to U.S. Patent No. 7,955,012 B2), mailed Jul. 20, 2010.

United States Patent and Trademark Office, Office Action for U.S. Appl. No. 13/429,258 (continuation of co-pending U.S. Appl. No. 13/101,111), dated Jul. 17, 2012.

PRINTER WITH FORCE TRANSMITTING PATH SELECTING MECHANISM

CROSS REFERENCE TO RELATED APPLICATIONS

This application is a continuation application of U.S. patent application Ser. No. 13/852,768, filed Mar. 28, 2013, which is a continuation application of U.S. patent application Ser. No. 13/101,111, filed May 4, 2011, now U.S. Pat. No. 8,475,067 B2, issued Jul. 2, 2013, which is a divisional application of U.S. patent application Ser. No. 11/513,179, filed Aug. 31, 2006, now U.S. Pat. No. 7,955,012 B2, issued Jun. 7, 2011, which claims the benefit of Japanese Patent Applications No. 2005-252136 filed on Aug. 31, 2005, No. 2005-285287 filed on Sep. 29, 2005, and No. 2005-286155 filed on Sep. 30, 2005, the disclosures of each of which are incorporated herein by reference in their entirety.

BACKGROUND OF THE INVENTION

1. Field of the Invention

The present invention relates to a printer for printing on a sheet. The printer of the present invention is generic name of a device comprising: a sheet sending mechanism which successively sends cut sheets; and a printing mechanism which successively prints characters, graphics, photographic images or the like on the sheets sent by the sheet sending mechanism. Not only a printer with a single function, but also a copying device, a facsimile device, a composite device (or a multifunction device) and the like comprising the sheet sending mechanism and printing mechanism also are the printer described herein.

In one type of printer of the present invention, a sheet sending mechanism is operated in a plurality of operation modes. In order to operate the sheet sending mechanism in the plurality of operation modes, the printer of the present invention comprises a plurality of force transmitting paths and a selecting mechanism for activating any of the force transmitting paths.

Other type of the printer of the present invention comprises a plurality of sheet sending mechanisms. In order to operate the plurality of sheet sending mechanisms, the printer of the present invention comprises a plurality of force transmitting paths and a selecting mechanism for activating any of the force transmitting paths.

Yet further type of the printer of the present invention comprises a maintaining mechanism for a printing head. In order to operate the maintaining mechanism and the sheet sending mechanism, the printer of the present invention comprises a plurality of force transmitting paths and a selecting mechanism for activating any of the force transmitting paths.

2. Description of the Related Art

There has been conventionally known printers with single function which can print on a plurality of sizes of sheets, and printers such as copying machines, facsimile devices, composite devices, and the like. These types of printers use a plurality of cassettes that store a plurality of sheets having the same size in a stacked manner. The sizes of the sheets stored in each cassette are different from one another. The plurality of cassettes are stored in the printer in a stacked manner. A cassette is selected in accordance with a command for designating the size of the sheet or an image command. The uppermost sheet of the sheets stacked in a selected cassette is sent by a supply roller. The sheet which is sent from the cassette is conveyed toward a printing region secured in a lower section of a printing head via a conveying path. This type of printer comprises a plurality of sheet sending mechanisms.

As disclosed in Japanese Patent Application Laid-Open Publication No. H8-174958 or Japanese Patent Application Laid-Open Publication No. 2003-89244, there is known a printer which comprises an ink-jet type printing head for printing a graphic pattern configured with dot patterns. In the ink-jet type printing head, ejection failure of the inks occurs due to the structure of the printing head, thus the ink-jet type printing head is provided with a maintaining mechanism in the printer in order to cope with such ink ejection failure. The printing head is moved to a position facing the maintaining mechanism, and the printing head is treated by the maintaining mechanism at this position. This type of printer comprises the maintaining mechanism and the sheet sending mechanism.

Among printers, there is a printer which can switch between a mode for continuously and successively sending sheets from a cassette and a mode for intermittently sending sheets from a cassette. This type of printer comprises a plurality of driving force transmitting paths in order to operate the sheet sending mechanism using a plurality of operation modes.

A driving force needs to be transmitted to the sheet sending mechanism or maintaining mechanism.

The printer disclosed in Japanese Patent Application Laid-Open Publication No. H8-174958 employs a structure of moving a kick member by using a movement of a carriage which moves the printing head. By means of a movement of the kick member, switching is made between a state in which an idle gear is engaged with a gear driving the maintaining mechanism, and a state in which the idle gear is engaged with a gear driving a sheet sending roller. In the printer disclosed in Japanese Patent Application Laid-Open Publication No. H8-174958, when the carriage is separated from a purge position, the idle gear is engaged with the gear driving the maintaining mechanism. When the carriage is at the purge position, the idle gear is engaged with the purge gear.

The printer disclosed in Japanese Patent Application Laid-Open Publication No. 2003-89244 comprises: a supply gear which rotates a supply gear sending one sheet from a plurality of stacked sheets; a feed gear which rotates a feed-in roller sending a sheet to a printing region and a feed-out roller drawing the sheet from the printing region; a maintenance gear which drives a maintaining mechanism; and a drive motor. Also, there is provided a slider which moves after the carriage moves so that power is transmitted to any of the supply gear, feed gear, and maintenance gear from the drive motor. The slider comprises a switching gear. When the slider slides, the switching gear is engaged with any one of the supply gear, feed gear, and maintenance gear.

In this printer, if the carriage is positioned within a width of a sheet, the switching gear and supply gear are engaged with the feed gear. When the printer executes a maintenance work, the carriage is moved to a maintenance position. Accordingly, the switching gear is engaged with the maintenance gear. When the printer discharges the last page of the sheets, the carriage is moved to an intermediate position between the abovementioned two positions. Accordingly, the switching gear is engaged with the feed gear.

BRIEF SUMMARY OF THE INVENTION

However, in the conventional configuration, the position of the idle gear or switching gear changes in conjunction with the position of the carriage. In other words, the position of the carriage determines the position of the idle gear or switching gear. Therefore, the carriage has to be moved every time when executing a processing of sending a sheet from the cassette or a process of conveying the sheet which is sent from the cassette, requiring time for moving the carriage and excessive time for making a connection (engagement) between the gears. Therefore, there is a problem that continuous printing cannot be performed promptly and efficiently.

Further, the conventional configuration cannot respond to a printer comprising a plurality of cassettes and a plurality of sheet sending mechanisms.

The present invention is to solve the abovementioned problems.

An object of the present invention is to realize a structure capable of switching a power transmitting path by moving a carriage.

Other object of the present invention is to provide a printer in which, by switching a power transmitting path by means of a movement of the carriage, thereafter the switched power transmitting path can be maintained even when the carriage is separated from its position, and the carriage can be moved for an original purpose.

Yet another object of the present invention is to provide a printer which can response to a case in which a plurality of cassettes are disposed to configure a plurality of steps.

A printer of the invention comprises a printing head and a carriage. The printing head is mounted on the carriage, and the carriage is movable between a first end and a second end of a reciprocating path. The reciprocating path extends along a width direction of a sheet to be printed.

The printer of the invention also has a driving force transmitting path selecting mechanism. This mechanism is provided at the second end of the reciprocating path.

The selecting mechanism comprises a common driving force outputting member, a plurality of force receiving members, and a selecting member for connecting the force outputting member to one of the plurality of force receiving members via the selecting member. The selecting member moves in association with the carriage when the carriage moves in a vicinity of the second end in a first direction extending from the first end to the second end. The selecting mechanism also has a position retainer that keeps the position of the selecting member when the carriage moves in a second direction extending from the second end to the first end. The force receiving member connected to the force outputting member via the selecting member is selected in accordance with a movement of the carriage along the reciprocating path.

According to this printer, the carriage is moved in the first direction in order to change the position of the selecting member. Once the selecting member is positioned to a desired position so that the desired force receiving member is connected to the force outputting member, then the carriage may be moved in the second direction. Because the position retainer keeps the position of the selecting member when the carriage moves in the second direction, the selected force receiving member continues to be connected to the force outputting member. Once the selection is completed, then the carriage can move freely for its own purpose of printing on sheet.

According to this printer, the force receiving member connected to the force outputting member is determined by a nearest position to the second end during the reciprocating movement of the carriage. For instance, in case that a first point is the first point from the second end, a second point is the second point from the second end, the force receiving member corresponding to the first point is selected by moving the carriage in the first direction up to the first point and then moving in the second direction. On the other hand, the force receiving member corresponding to the second point is selected by moving the carriage in the first direction up to the second point and then moving in the second direction.

According to this printer, since the selection is maintained even the carriage is moved to a far position from the second end, the carriage may stay in a printing region (region of opposing the sheet) for printing. The occasion for the carriage to travel to the vicinity of the second end for changing the selection may be reduced. Waste of time for changing the selection of driving force transmitting path is prevented.

It is preferred that the printer have a sheet sending mechanism for sending the sheet to be printed from a cassette to a printing region; and a maintaining mechanism for maintaining the printing head. In this case, it is preferred that one of the force receiving members activate the sheet sending mechanism and the other of the force receiving members activate the maintaining mechanism.

According to this printer, once the force receiving member for activating the sheet sending mechanism is selected, then the carriage may be moved to the printing region (region of opposing the sheet) for printing. The carriage may stay in the printing region until the maintaining operation becomes necessary.

It is also preferred that the printer have a first sheet sending mechanism for sending the sheet to be printed from a first cassette to a printing region, a second sheet sending mechanism for sending the sheet to be printed from a second cassette to the printing region, and a maintaining mechanism for maintaining the printing head. In this case, it is preferred that first force receiving member activate the first sheet sending mechanism, second force receiving member activate the second sheet sending mechanism, and third force receiving members activate the maintaining mechanism.

It is also preferred that the printer have a first-first sheet sending mechanism for sending the sheet to be printed from a first cassette to a printing region intermittently, a first-second sheet sending mechanism for sending the sheet to be printed from the first cassette to the printing region sequentially, a second sheet sending mechanism for sending the sheet to be printed from a second cassette to the printing region, and a maintaining mechanism for maintaining the printing head. In this case, it is preferred that first-first force receiving member activate the first-first sheet sending mechanism, first-second force receiving member activate the first-second sheet sending mechanism, second force receiving member activate the second sheet sending mechanism, and third force receiving members activate the maintaining mechanism.

According to this printer, the sheet is sent to the printing region from the first cassette by two ways. When the first-first sending mechanism is selected and activated, the sheet sent from the first cassette is aligned to a predetermined position, and the sheet is send to the printing region from the aligned position. According to this way of sending the sheet, the relation between the position of the sheet and timing of the printing head operation is adjusted to a predetermined relation, therefore intended graphic pattern can be printed at intended position of the sheet. When the first-second sending mechanism is selected and activated, pieces of sheets are continuously sent out from the first cassette. According to this way of sending the sheet, continuous printing operation becomes possible for multiple sheets; therefore printing operation for multiple sheets can be completed quickly.

The common force outputting member may be a spur gear. The selecting member may be also a spur gear that is in mesh with the spur gear forming the common force outputting member. Each of the force receiving members may also be a spur gear. In this case, it is preferred that spur gears forming the force receiving members be arranged along a line, and one of the spur gear forming the force receiving members is in mesh with the spur gear forming the selecting member.

According to this structure, the driving force transmitting path selecting mechanism is simplified.

The position retainer may have a first slider that moves in association with the carriage when the carriage moves in a vicinity of the second end. The first slider moves the selecting member when first slider moves in the first direction. The position retainer may also have a position retaining member that keeps the position of the first slider at a plurality positions.

The first slider may have an arm that abuts the carriage and the position retaining member.

The position retaining member may have a guide groove. The arm of the first slide member is inserted into the groove.

The guide groove may have steps for engaging with the arm.

The guide groove may have a lateral portion extending along the reciprocating path and an inclined portion inclined with respect to the reciprocating path.

The guide groove may have a first wall and a second wall. In this case, the arm travels along the first wall when the carriage travels in the first direction, and the arm travels along the second wall when the carriage travels in the second direction. The first wall may have a step for retaining the position of the arm, and the second wall has no step for retaining the position of the arm.

According to this guide groove, when the carriage is returned toward the first end while the carriage travels under the condition that the arm travels along the first wall, then the arm is engaged with a step formed on the first wall, and the force receiving member connected to the force outputting member is determined by a nearest position to the second end during the reciprocating movement of the carriage. When the carriage is moved up to the second end, then the arm is rotated and inserted into the lateral portion. When the carriage is returned toward the second end after the arm is inserted into the lateral portion, the arm travels along the second wall. Because, the second wall does not have a step, then the arm is returned to the step formed on the first wall which is nearest to the first end. Then the selection is cleared up, and new selection becomes possible.

The selecting member and the first slider may be mounted to a common axis. It is preferred that the selecting member and the first slider can rotate and slide with respect to the axis independently.

It is preferred that the carriage has a step for preventing the arm from rotating.

It is preferred that the position retainer further comprise a second slider that applies a rotating force to the first slider such that the arm is biased against the first wall while the carriage moves in the first direction.

It is preferred that the selecting member, the first slider and the second slider be mounted to a common axis, and the selecting member, the first slider and the second slider can slide with respect to the axis independently.

It is preferred that the second slider be prohibited to rotate with respect to the axis.

It is preferred that the position retaining member be fixed to a flame for guiding reciprocation of the carriage.

DETAILED DESCRIPTION OF THE INVENTION (First Embodiment)

Figure 1:
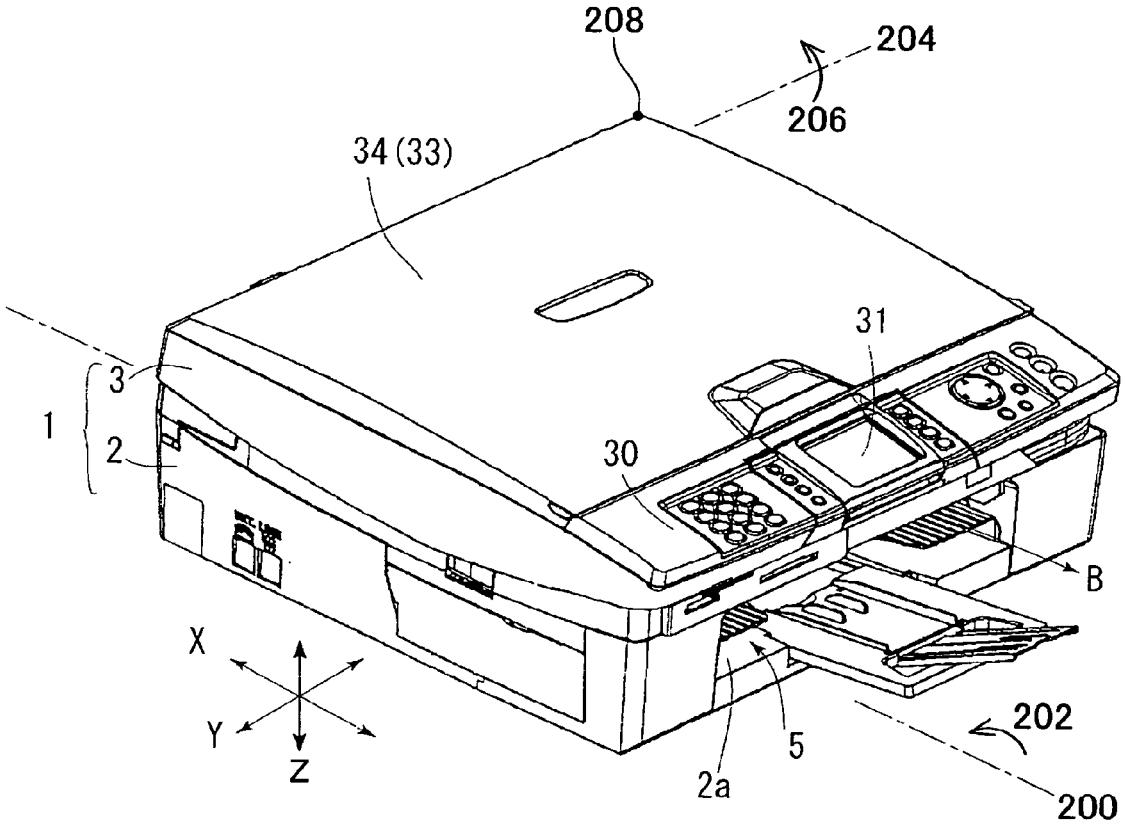
FIG. 1 is a perspective view showing the entirety of a multifunction device of a first embodiment.

The first embodiment which crystallizes the present invention is described in detail with reference to the drawings. FIG. 1 shows a perspective view showing an exterior of a multifunction device 1 which comprises a facsimile function, print function, copy function, and scanner function. The multifunction device 1 comprises a sheet sending mechanism for sending a sheet and a printing mechanism for printing characters, graphics, photographic images or the like (generically referred to as "graphic pattern" hereinafter) on the sheet which is sent by the sheet sending mechanism, and provides the sheet printed with the graphic pattern to a user.

The multifunction device 1 has a lower section case 2 and an upper section case 3. The lower section case 2 is substantially in the form of a box in which an upper surface thereof is opened. The upper section case 3 is connected to a left side face of the lower section case 2 via a hinge (not shown), and can be rotated from the position thereof shown in FIG. 1, in a direction of the arrow 202 around a rotation axis 200. When the upper section case 3 is rotated in the direction of the arrow 202, the inside of the lower section case 2 can be viewed from the outside. The lower section case 2 and the upper section case 3 are injection-molded articles made of synthetic resin.

It should be noted that in the following description an X-direction in FIG. 1 is referred to as "front-and-back direction", a Y-direction is referred to as "horizontal direction", and a Z-direction is referred to as "vertical direction".

An operation panel 30 is disposed on an upper face front section of the upper section case 3. The operation panel 30 is provided with various buttons such as a numeric button, a start button, and a function section button so that various operations can be performed by pressing these buttons. The operation panel 30 is further provided with a liquid crystal display (LCD) 31 on which the setting status of the multifunction device 1, various operation messages and the like are displayed according to need.

A scanner device 33 is disposed inside the upper section case 3. The scanner device 33 comprises a glass plate (not shown) for placing a script, a graphic pattern reading section (not shown) disposed directly below the glass plate, and a cover body 34 for covering an upper face of the glass plate. The cover body 34 can be rotated from the position thereof shown in FIG. 1, in a direction of the arrow 206 around a rotation axis 204. When the cover body 34 is rotated in the direction of the arrow 206, the glass plate is exposed so that a script can be placed on the glass plate. The graphic pattern reading section comprises a contact image sensor (CIS), which extends in the X direction in the figure, is guided by a rail which is not shown, and can reciprocally be moved in a direction of a Y-axis. The graphic pattern reading section uses the contact image sensor to read a graphic pattern on a script which is placed on the glass plate.

When the facsimile function is selected, information which is read by the graphic pattern reading section is transmitted to a facsimile device through a telephone line, the facsimile device being a transmission destination. When the copy function is selected, information which is read by the graphic pattern reading section is transmitted to the printing mechanism incorporated in the multifunction device 1, and the graphic pattern which is read by the graphic pattern reading section is printed on a sheet. When the scanner function is selected, information which is read by the graphic pattern reading section is transmitted to a computer which is not shown.

Position holding means is provided in order to rotate the upper section case 3 significantly around the rotation axis 200 and maintain the state where the interior of the lower section case 2 is exposed. The position holding means comprises a supporting rod (not shown) and a guide rail (not shown). One end of the supporting rod is installed in the vicinity a point 208 of the lower section case 2 and can be oscillated with respect to the lower section case 2. The guide rail extends in the Y-direction along a lower surface on the back edge of the upper section case 3. A groove extending in the Y-direction is formed on the guide rail. A guide pin is fixed on the other end of the supporting rod and inserted in the groove. An engaging section (not shown) for inhibiting the guide pin from sliding is formed in the vicinity of the point 208 of the groove. When the upper section case 3 is rotated significantly around the rotation axis 200, the guide pin of the supporting rod is buried in the engaging section of the guide rail, whereby the upper section case 3 is inhibited from rotating downward.

Figure 6:
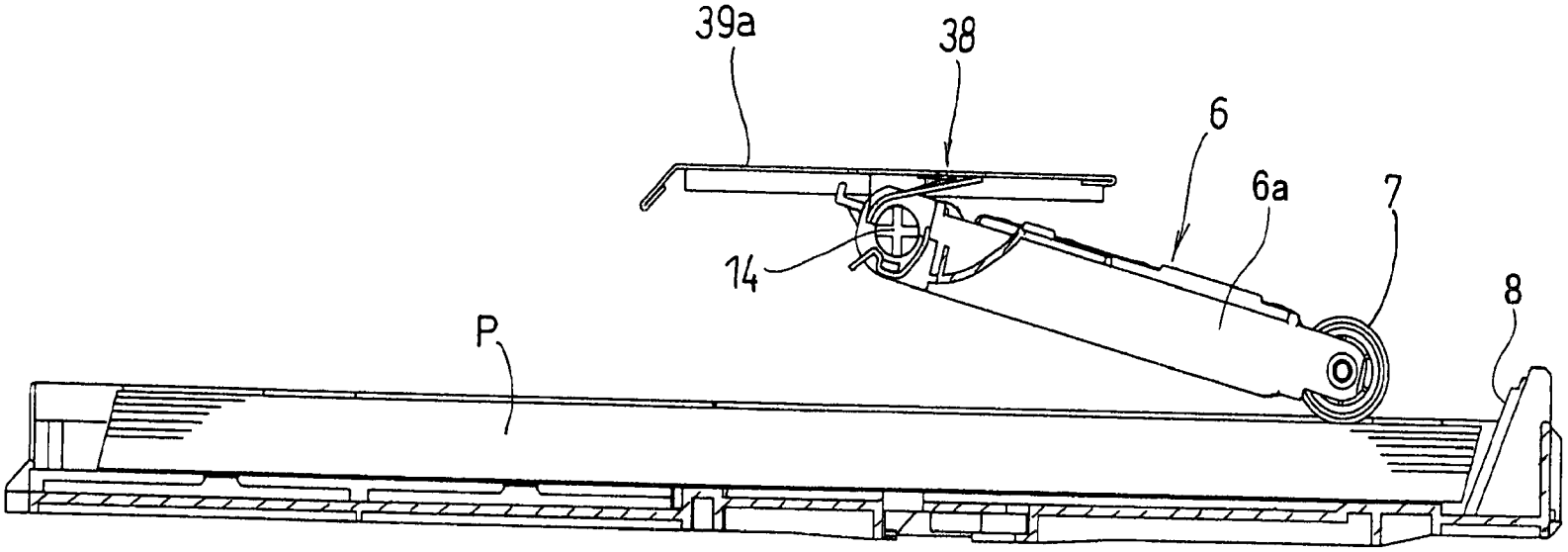
FIG. 6 is a side view of the paper cassette and a supply unit.

Next, the configuration of the sheet sending mechanism incorporated in the lower section case 2 is explained. As shown in FIG. 1, a paper cassette 5 is provided at the central section in the horizontal direction of the lower section case 2. The paper cassette 5 is configured such that it can be withdrawn with respect to an opening section 2*a* formed on a front surface of the lower section case 2. As shown in FIG. 6, a plurality of sheets P are stored in a stacked fashion in the paper cassette 5. Sheets, which are not printed with the graphic patterns, are stored in the paper cassette 5. A separating inclined surface 8, which is formed of a material having a high frictional coefficient, is prepared on a front wall of the paper cassette 5. When a supply roller 7, which is described later, is rotated in a counterclockwise direction, one piece of sheet P is taken out from the paper cassette 5 and sent to the printing mechanism incorporated in the lower section case 2. A sheet P, which is printed with the graphic pattern by the printing mechanism, is sent to a position located in an upper section of the paper cassette 5 by the sheet sending mechanism. The user can take out the sheet P, which is printed with the graphic pattern, from the opening section 2*a* shown in FIG. 1.

Figure 4:
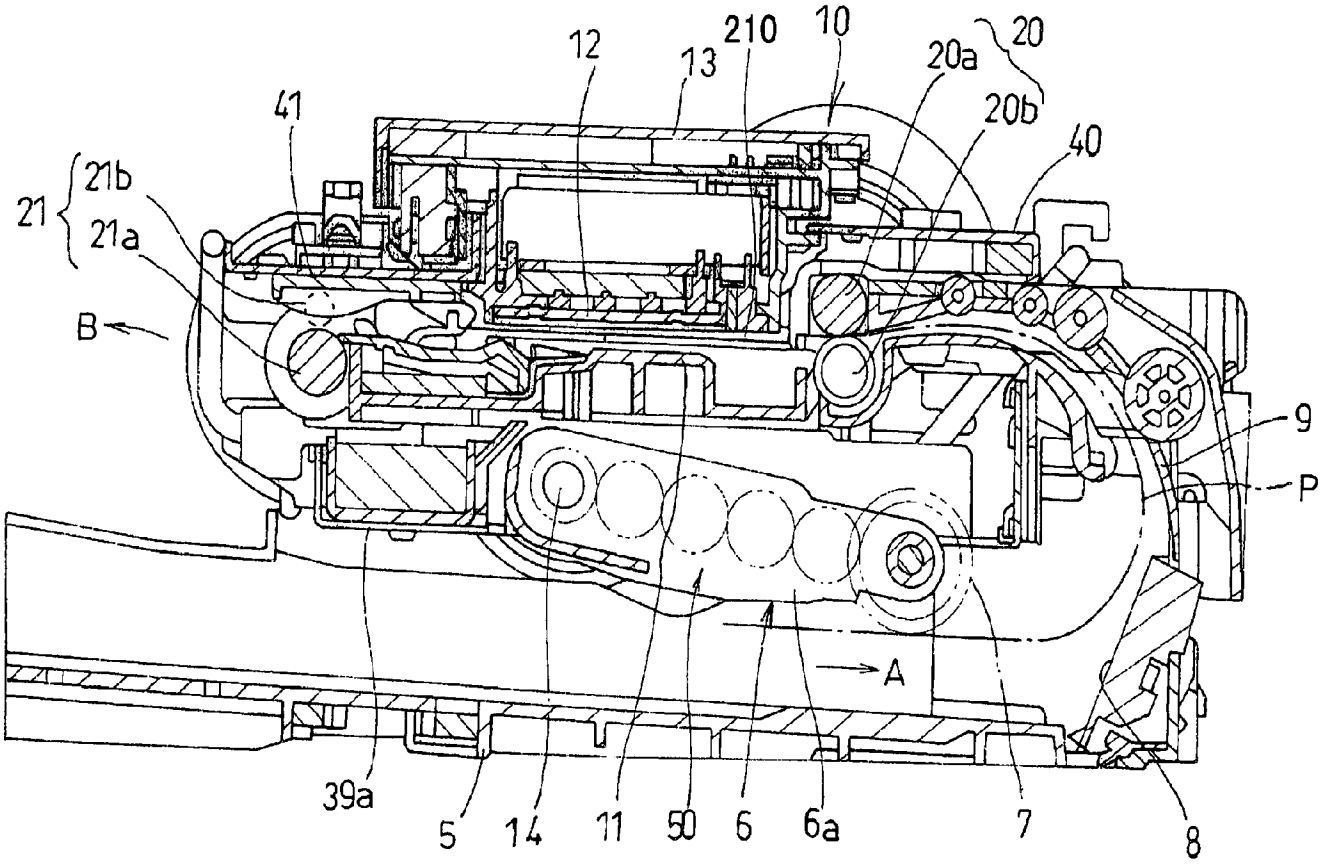
FIG. 4 is a cross-sectional view of a substantial part in which a paper cassette is installed in the multifunction device.

The sheet sending mechanism is stored in the lower section case 2. As shown in FIG. 4, the sheet sending mechanism comprises a supply unit 6, a sheet guide 9, a pair of feed-in rollers 20*a*, 20*b*, a tabular platen 11, and a pair of feed-out rollers 21*a*, 21*b*. The printing mechanism is stored in the lower section case 2 as well. A printing unit 10 is disposed in an upper part of the platen 11. A space through which the sheet P can pass is secured between the printing unit 10 and the platen 11, and this space is a printing region 210.

The supply unit 6 comprises the supply roller 7. When the supply roller 7 is rotated in a counterclockwise direction, one piece of sheet P is taken out from the paper cassette 5 and the taken sheet is send to the right in FIG. 4. The sheet guide 9 extends in U shape and guides the sheet P, which is sent from the paper cassette 5 by the supply roller 7, toward a space between the pair of feed-in rollers 20*a* and 20*b*. The pair of feed-in rollers 20*a*, 20*b* causes the sheet P to pass through the printing region 210 which is secured between the printing unit 10 and the platen 11, and sends the sheet P to a space between the pair of feed-out rollers 21*a* and 21*b*. The pair of feed-out rollers 21*a*, 21*b* sends the sheet P to the position located above the paper cassette 5. The pair of feed-in rollers 20*a*, 20*b* is positioned on an upstream side of the printing unit 10 and platen 11, and the pair of feed-out rollers 21*a*, 21*b* is positioned on a downstream side of the printing unit 10 and platen 11.

The printing unit 10 sprays ink droplets onto the sheet P which passes through the space 210 between the printing unit 10 and the platen 11 to print the graphic pattern on the sheet P. The printing unit 10 sprays the ink droplets onto the sheet P to print the graphic pattern thereon while the sheet P passes through the printing region 210.

Figure 2:
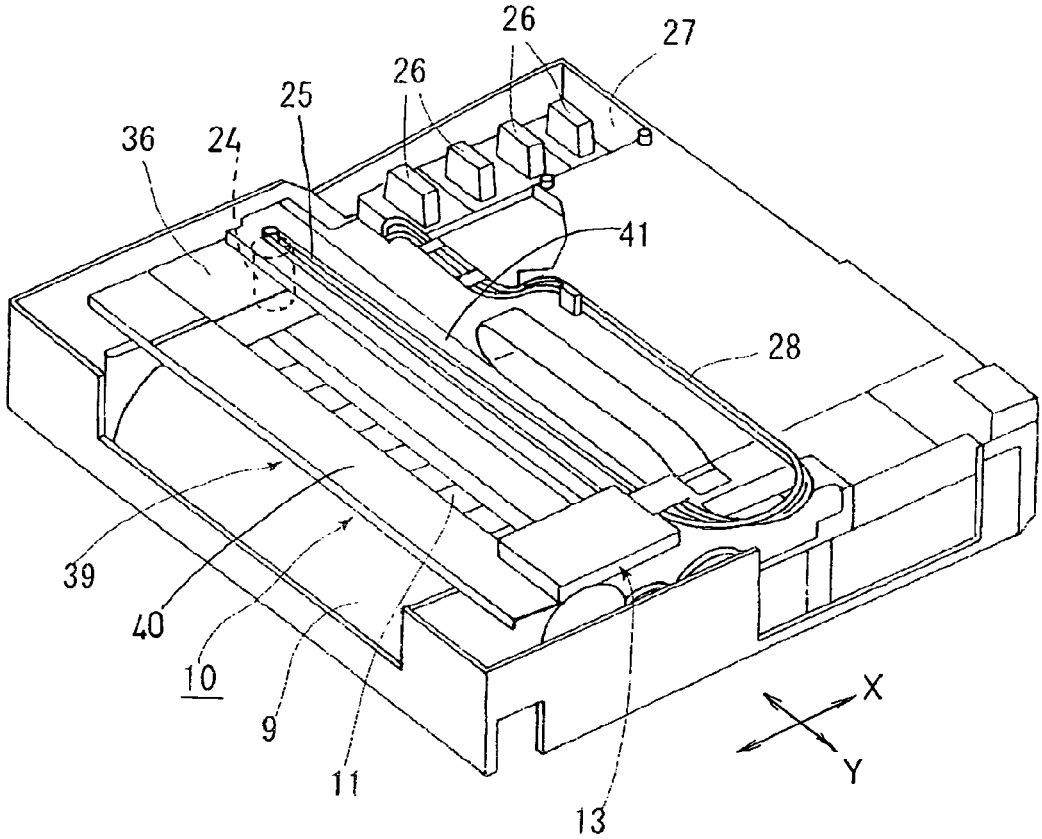
FIG. 2 is a perspective view in which a lower section case, excluding an upper section case, is viewed from the back.
Figure 3:
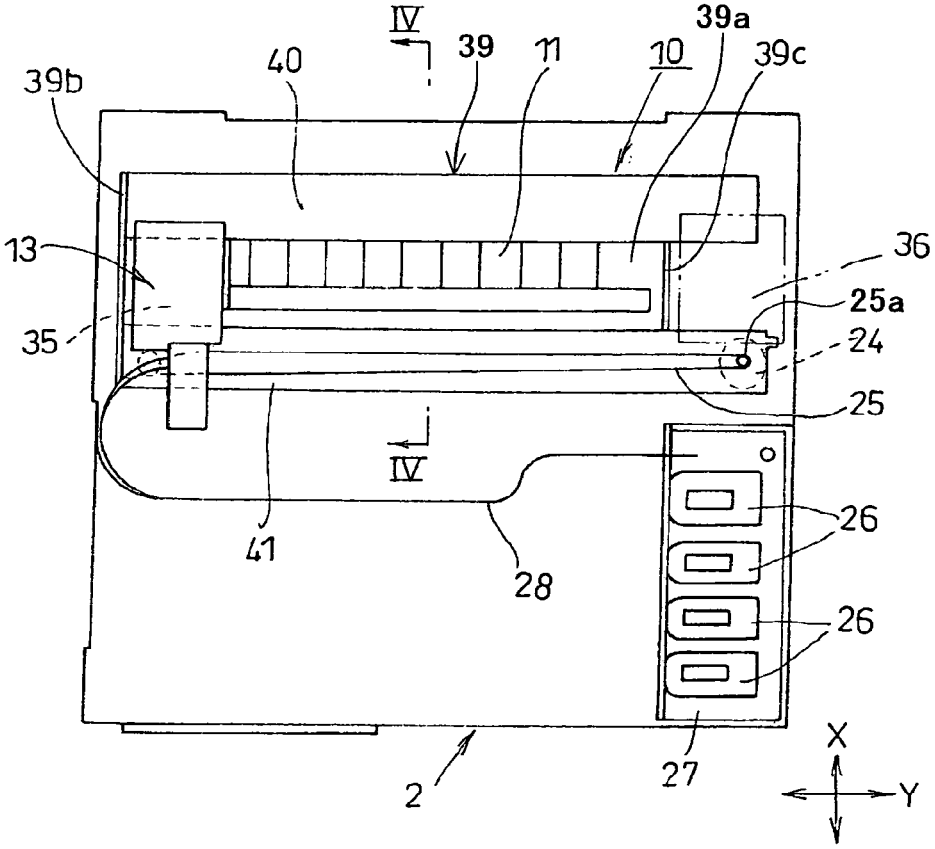
FIG. 3 is a top view of FIG. 2.

As shown in FIG. 2 and FIG. 3, the printing unit 10 comprises a frame 39 formed of a metal plate, a carriage 13, a timing belt 25 which reciprocates the carriage 13 in the Y-direction, and a carriage motor 24 ("CR motor" hereinafter) for rotating the timing belt 25. As shown in FIG. 4, a printing head 12 is mounted on the carriage 13.

As shown in FIG. 2 and FIG. 3, the frame 39 is disposed on the upper section of the paper cassette 5 on the back of the lower section case 2. The frame 39 is made of metal plate and comprises, as shown in FIG. 3 and FIG. 4, a bottom surface 39*a* extending in the Y-axis direction, a left wall 39*b* which is standing upward from a left end of the bottom surface 39*a*, a right wall 39*c* which is standing upward from a right end of the bottom surface 39*a*, a front side guide place 41 which connects the left wall 39*b* and the right wall 39*c*, and a backside guide plate 40 which connects the left wall 39*b* and the right wall 39*c*. The front side guide place 41 and the backside guide plate 40 extend in the Y-direction.

Figure 7:
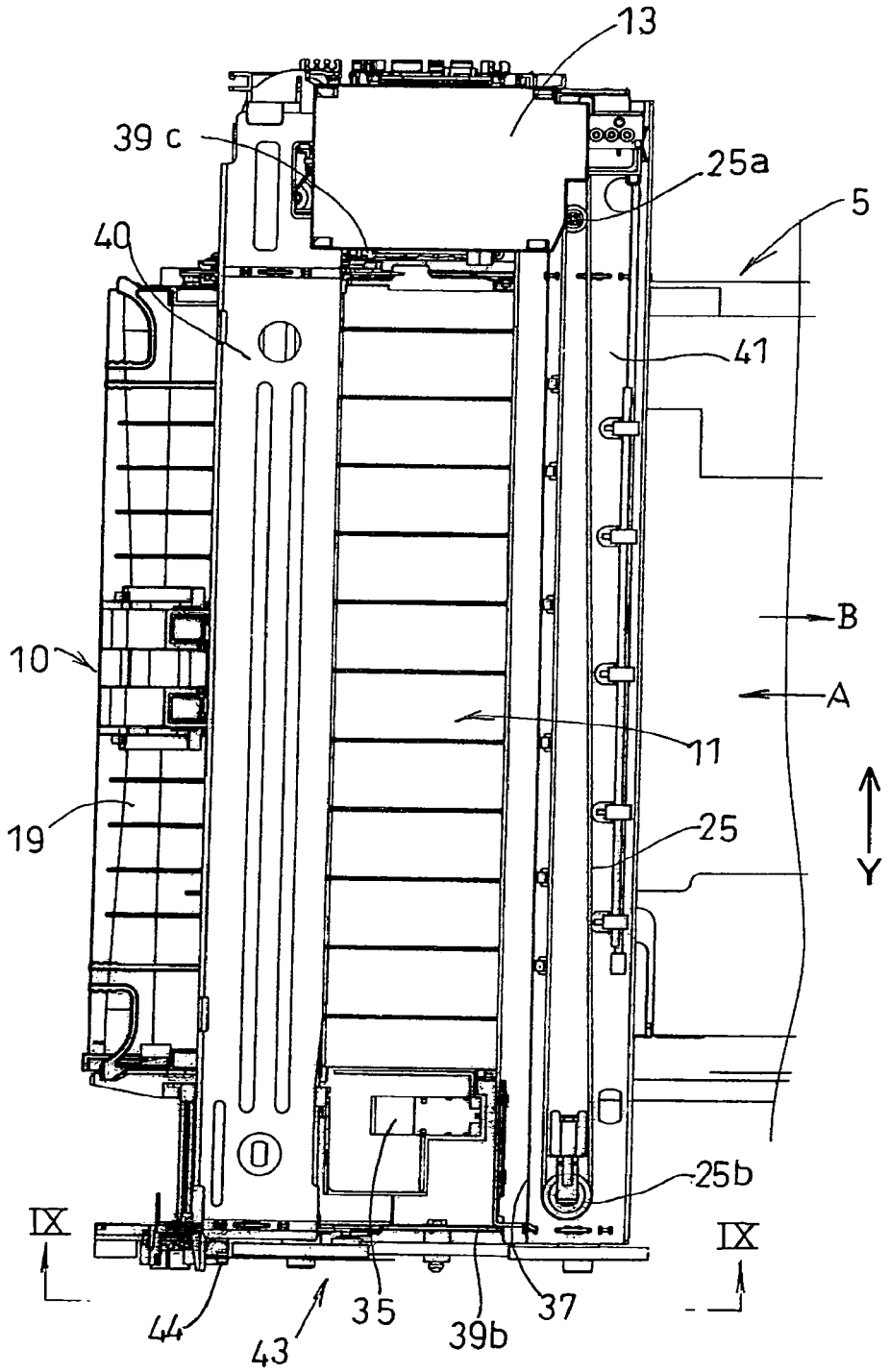
FIG. 7 is a plan view of a cut-out section in which the paper cassette is installed in the multifunction device.

As shown in FIG. 7, the timing belt 25, which is wrapped around pulleys 25*a* and 25*b*, is disposed on an upper surface of the guide plate 41. The timing belt 25 extends in a main scanning direction (Y-axis direction). The carriage 13 is coupled on a part of the timing belt 25. As shown in FIG. 3, the pulley 25*a* is rotated by the CR motor 24. The carriage 13 and the printing head 12 are caused to reciprocate in the Y-direction by a reciprocal rotation of the CR motor 24.

As shown in FIG. 7, a linear encoder (encoder strip) 37 extending in the main scanning direction (Y-axis direction) is disposed on the upper surface of the guide plate 41. The linear encoder 37 detects the position of the carriage 13 in the Y-axis direction. The linear encoder 37 has a strip-like shape, and a control surface thereof is formed with slits which are disposed at regular intervals in the Y-axis direction. The control surface of the linear encoder 37 is disposed along a vertical surface.

As shown in FIG. 4, the platen 11 is fixed onto the bottom surface 39*a* of the frame 39. As shown in FIG. 6, a drive shaft 14 of the supply unit 6 is rotatably attached to the bottom surface 39*a* of the frame 39. The supply unit 6 comprises an arm 6*a* which is rotatable around the drive shaft 14, a torsion spring 38 which biases the arm 6*a* in a clockwise direction, the supply roller 7 which is rotatably attached to a front end of the arm 6*a*, and a mating gear train 50 for transmitting torque from the drive shaft 14 to the supply roller 7 (see FIG. 4).

Since the arm 6*a* is rotatable around the drive shaft 14, it does not interfere with a sliding motion of the paper cassette 5. When the paper cassette 5 is pushed into the lower section case 2, the supply roller 7 contacts with the upper surface of the uppermost sheet P of the plurality of sheets stored in the paper cassette 5. When the supply roller 7 is rotated in a counterclockwise direction, the uppermost sheet P is taken out from the paper cassette 5, guided by the sheet guide 9 and travels toward the space between the pair of feed-in rollers 20*a* and 20*b*.

Both end sections of the pair of feed-in rollers 20*a*, 20*b* are supported rotatably by the left wall 39*b* and right wall 39*c* of the frame 39. Both end sections of the pair of feed-out rollers 21*a*, 21*b* are supported rotatably by the left wall 39*b* and right wall 39*c* of the frame 39.

Of the pair of feed-in rollers 20*a*, 20*b*, the feed-in roller 20*a*, which is positioned above, is rotated by a motor which is described later. The feed-in roller 20*b*, which is positioned below, is pressed against the feed-in roller 20*a* by a certain force. When the feed-in roller 20*a* rotates, the feed-in roller 20*b* also rotates with the rotation of the feed-in roller 20*a*. The feed-in roller 20*a* is a feed-in drive roller 20*a*, and the feed-in roller 20*b* is a feed-in driven roller 20*b*.

Similarly, of the pair of feed-out rollers 21*a*, 21*b*, the feed-out roller 21*a*, which is positioned below, is rotated by the motor which is described later. The feed-out roller 21*b*, which is positioned above, is pressed against the feed-out roller 21*a* by a certain force. When the feed-out roller 21*a* rotates, the feed-out rollers 21*b* also rotates with the rotation of the feed-out roller 21*a*. The feed-out roller 21*a* is a feed-out drive roller 21*a*, and the feed-out roller 21*b* is a feed-out driven roller 21*b*.

When the feed-in drive roller 20*a* rotates in a clockwise direction in a state where a sheet P is held between the pair of feed-in rollers 20*a* and 20*b*, the sheet P is sent to the printing region 210 between a lower surface of the printing head 12 and the platen 11. When the feed-in drive roller 20*a* rotates in a clockwise direction and the feed-in driven roller 20*b* rotates in a counterclockwise direction, the sheet is sent to the printing region 210. This situation is called "forward rotation of the pair of feed-in rollers". The power of the pair of feed-in rollers 20*a*, 20*b* to send the sheet P is stronger than the power of supply roller 7 to send the sheet P. The speed of the pair of feed-in rollers 20*a*, 20*b* to send the sheet P is faster than the speed of the supply roller 7 to send the sheet P. Since the power of the pair of feed-in rollers 20*a*, 20*b* to send the sheet P is stronger than the power of the supply roller 7 to send the sheet P, when a piece of sheet P is sent by both the pair of feed-in rollers 20*a*, 20*b* and the supply roller 7, the sheet P is sent at the sending speed of the pair of feed-in rollers 20*a*, 20*b*. The sheet P slides with respect to the supply roller 7. The sending speed of the pair of feed-in rollers 20*a*, 20*b* to send the sheet P is equal to the sending speed of the pair of feed-out rollers 21*a*, 21*b* to send the sheet P.

On the lower surface of the printing head 12, a plurality of nozzles for injecting black ink droplets, a plurality of nozzles for injecting cyan ink droplets, a plurality of nozzles for injecting magenta ink droplets, and a plurality of nozzles for injecting yellow ink droplets are formed. The printing head 12 is mounted on the carriage 13 and moves in the Y-direction. The sheet P, onto which the ink droplets are sprayed, is sent in the upper section of the platen 11 in the X-direction by the pair of feed-in rollers 20*a*, 20*b*. By combining the sending of the sheet P in the X-direction and the sending of the printing head 12 in the Y-direction, any color of ink droplets can be sprayed onto any position on the sheet P, and thereby any graphic pattern can be printed on the sheet P.

As shown in FIG. 2 and FIG. 3, ink cartridges 26 for supplying inks to the printing head 12 are stored in the lower section case 2. The ink cartridges 26 are configured so as to be detachable from above with respect to a storage section 27 (see FIG. 2 and FIG. 3) which is formed in a position far away from the rotation axis 200 shown in FIG. 1. In the present embodiment, an ink cartridge storing the black ink, an ink cartridge storing the cyan ink, an ink cartridge storing the magenta ink, and an ink cartridge storing the yellow ink are used. More ink cartridges may be used. Each of the ink cartridges 26 and the printing head 12 is connected with each other by a flexible ink tube 28.

As shown in FIG. 3, an ink receiving section 35 is provided in a section which is located outside the width of a sheet P to be conveyed (short side of the sheet P) and in the vicinity of the left wall 39*b* of the frame 39. A maintaining mechanism 36 is provided in a section which is located outside the width of the sheet P to be conveyed and in the vicinity of the right wall 39*c* of the frame 39.

The printing head 12 periodically discharges ink to the ink receiving section 35 in order to prevent clogging of the nozzles. The ink, which is discharged to prevent the clogging, is received at the ink receiving section 35.

When the printing head 12 is not used, the printing head 12 is moved to a position facing the maintaining mechanism 36. In this position, a cap section 36*a* (see FIG. 8) covers a nozzle surface of the printing head 12 from below to prevent the ink from drying in the nozzles of the printing head 12. Moreover, at a required timing, a recovery process and the like are performed in which a suction pump (not shown) is activated to draw the ink from the nozzles and air bubbles are removed from a buffer tank (not shown) provided on the printing head 12. It should be noted that when the carriage 13 moves from a position facing the mechanism 36 toward the printing region 210 in a lateral direction (Y direction), cleaning of the printing head 12 is performed by wiping the nozzle surface thereof using a wiper blade 36*b* (see FIG. 8).

The carriage 13 travels, in the Y-direction, back and forth between a position existing in an upper section of the ink receiving section 35 and a position existing on an upper section of the maintaining mechanism 36. The position existing in the upper section of the ink receiving section 35 is called "first end", and the position existing in the upper section of the maintaining mechanism 36 is called "second end".

The feed-in drive roller 20*a*, feed-out drive roller 21*a*, supply roller 7, and maintaining mechanism 36 are driven by the same motor (LF motor) 42.

Figure 8:
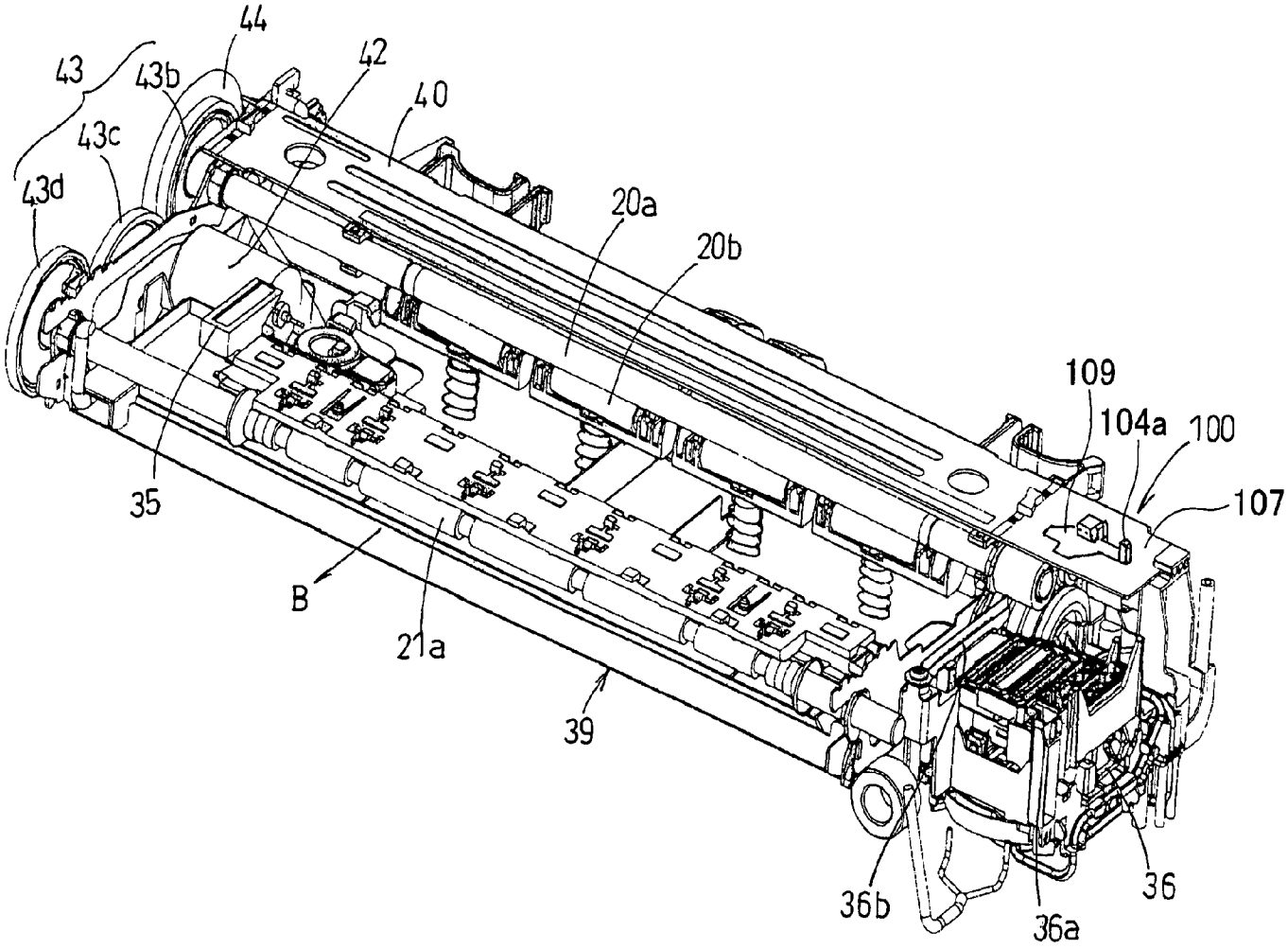
FIG. 8 is a perspective view of a printing unit in which a guide plate and platen on a back side thereof are removed.
Figure 9:
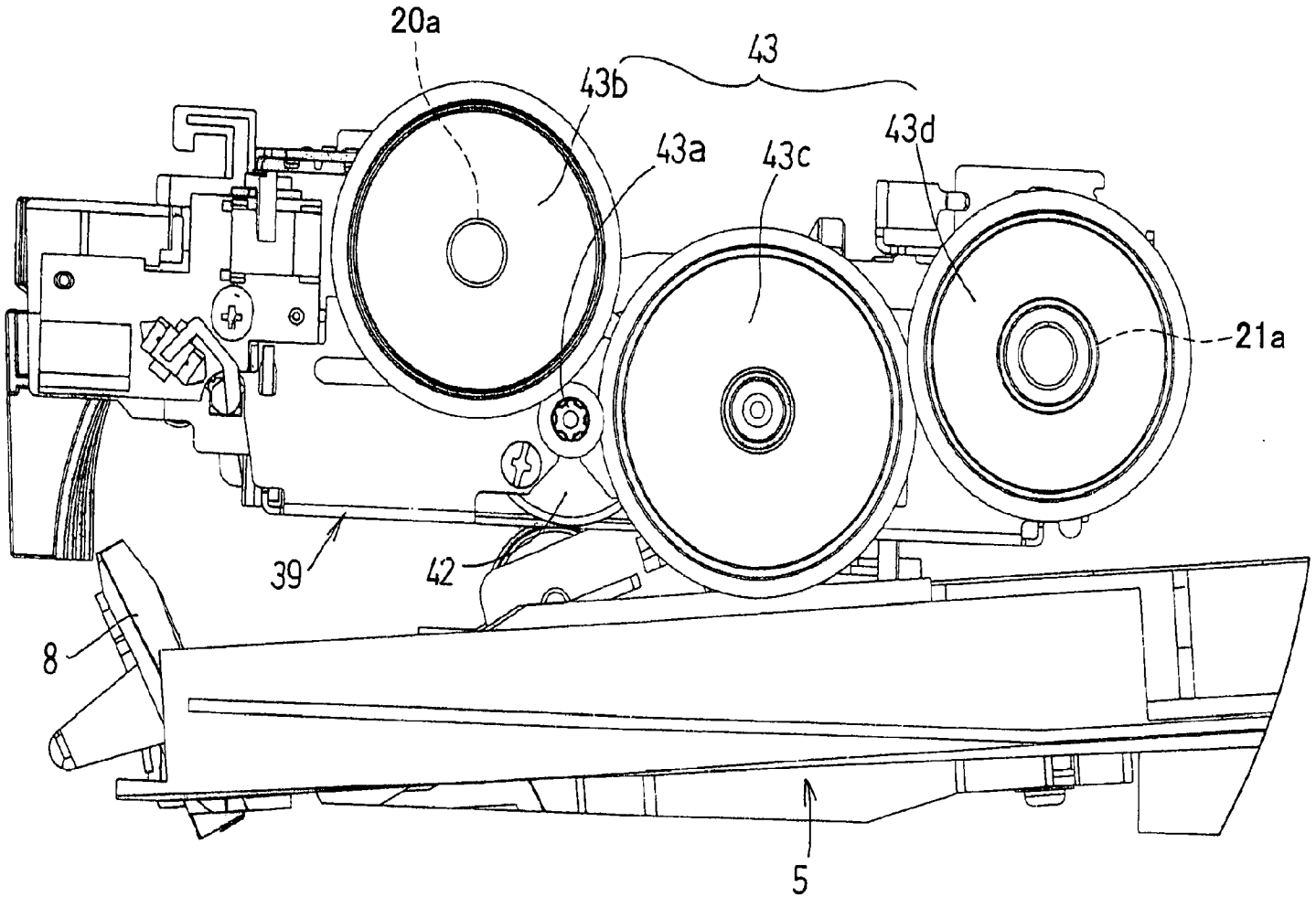
FIG. 9 is a figure taken along the line IX-IX of FIG. 7.

As shown in FIG. 8, the LF motor 42 is disposed at a left end section of the frame 39. A shaft of the LF motor 42 penetrates through the left wall 39*b* of the frame 39 and extends to the outside of the frame 39. As shown in FIG. 9, a pinion 43*a* is fixed to the shaft of the LF motor 42. Gears 43*b*, 43*c* and 43*d* are rotatably supported outside of the left wall 39*b*.

Figure 10:
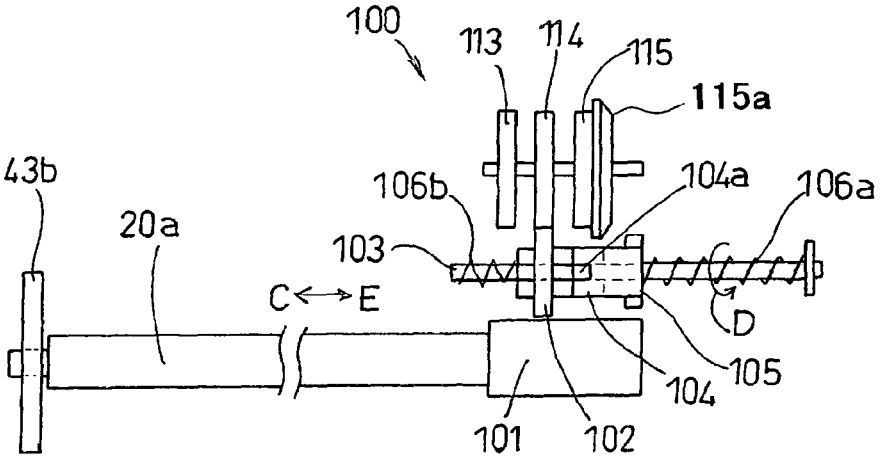
FIG. 10 is a schematic diagram showing power transmission switching means.

As shown in FIG. 9, the gear 43*b* is geared with the pinion 43*a*. As shown in FIG. 10, the feed-in drive roller 20*a* is fixed to the gear 43*b*. When the LF motor 42 rotates, the feed-in drive roller 20*a* rotates. As shown in FIG. 9, the gear 43*d* is geared with the pinion 43*a* via the intermediate gear 43*c*. The feed-out drive roller 21*a* is fixed to the gear 43*d*. When the LF motor 42 rotates, the feed-out drive roller 21*a* rotates.

The gear 43*b* and the gear 43*d* rotate in the counter direction. Therefore, the feed-in drive roller 20*a* and the feed-out drive roller 21*a* also rotate in the counter direction. The feed-in drive roller 20*a* abuts on the top surface of the sheet P and the feed-out drive roller 21*a* abuts on the bottom surface of sheet P. Therefore, if the direction of rotation of the feed-in drive roller 20*a* and the feed-out drive roller 21*a* is reversed, the sending direction of the sheet P by the feed-in drive roller 20*a* and the sending direction of the sheet P by the feed-out drive roller 21*a* become the same direction.

The LF motor 42 is a DC motor and can rotate in both forward and reverse directions.

As shown in FIG. 10, a gear 101 is fixed to the feed-in drive roller 20*a* within a range located at a right end section of the feed-in drive roller 20*a*, i.e. the upper section of the maintaining mechanism 36. The gear 101 is geared with one of three gears 113, 114 and 115 disposed adjacent to the gear 101, and rotates one of the three gears 113, 114 and 115. Power transmission switching means 100 selects a gear to be engaged with the gear 101. A movement of the carriage 13 in the Y-direction is used to select the gear to be engaged with the gear 101 by means of the power transmission switching means 100.

When the gear 113 is engaged with the gear 101, and the LF motor 42 rotates in the reverse direction, the supply roller 7 is rotated in the forward direction. When the gear 114 is engaged with the gear 101, and the LF motor 42 rotates in the forward direction, the supply roller 7 is rotated in the forward direction. When the gear 115 is engaged with the gear 101, the LF motor 42 moves the maintaining mechanism 36.

When the LF motor 42 rotates in the reverse direction, the feed-in drive roller 20*a* rotates in the reverse direction and in a direction of returning the sheet to the sheet guide 9. When the LF motor 42 rotates in the forward direction, the feed-in drive roller 20*a* rotates in the forward direction and in a direction of sending the sheet to the printing region 210. When the supply roller 7 rotates in the forward direction, the sheet is taken out from the cassette and sent to the sheet guide 9. When the supply roller 7 rotates in the reverse direction, the sheet is returned to the cassette 5.

When the LF motor 42 rotates in the forward direction in a state where the gear 113 is engaged with the gear 101, the pair of feed-in rollers 21*a*, 21*b* rotates in the forward direction, and the supply roller 7 rotates in the reverse direction. When the LF motor 42 rotates in the reverse direction in the state where the gear 113 is engaged with the gear 101, the pair of feed-in rollers 21*a*, 21*b* rotates in the reverse direction, and the supply roller 7 rotates in the forward direction. When the LF motor 42 rotates in the forward direction in a state where the gear 114 is engaged with the gear 101, the pair of feed-in rollers 21*a*, 21*b* rotates in the forward direction, and the supply roller 7 rotates in the forward direction.

As shown in FIG. 8, a rotary encoder 44 which rotates integrally with the gear 43*b* is provided. The amount of sheet P conveyed by the feed-in roller 20*a* can be detected by the rotary encoder 44. It should be noted that the CR motor 24 and LF motor 42 can be rotated in forward and reverse directions.

Next, the configuration of the power transmission switching means 100 is explained with reference to FIG. 10 and FIG. 11. The power transmission switching means 100 selects any of an intermittent feeding mode, a continuous feeding mode, and a maintenance mode. In the intermittent feeding mode, when the LF motor 42 rotates in the reverse direction, the supply roller 7 is rotated in the forward direction. In the continuous feeding mode, when the LF motor 42 rotates in the forward direction, the supply roller 7 is rotated in the forward direction. In the maintenance mode the torque of the LF motor 42 is transmitted to the maintaining mechanism 36.

In the intermittent feeding mode, when the LF motor 42 rotates in the reverse direction, the feed-in drive roller 20*a* rotates in a direction of returning the sheet to the sheet guide 9, and the supply roller 7 rotates in a direction of taking the sheet out from the cassette and sending it to the sheet guide 9. Thereafter, in the intermittent feeding mode, the LF motor 42 rotates in the forward direction. In the intermittent feeding mode, when the LF motor 42 rotates in the forward direction, the feed-in drive roller 20*a* rotates in a direction of sending the sheet to the printing region 210, and the supply roller 7 rotates in a direction of returning the sheet to the cassette.

When the LF motor 42 rotates in the reverse direction in the intermittent feeding mode, the sheet is sent to the pair of feed-in rollers 20*a*, 20*b* by the supply roller 7. Since the pair of feed-in rollers 20*a*, 20*b* is rotated in the reverse direction, the sheet cannot enter between the feed-in drive roller 20*a* and the feed-in driven roller 20*b*. The front edge of the sheet is aligned with a contact line with which the feed-in drive roller and the feed-in driven roller contact. The pair of feed-in rollers 20*a*, 20*b* rotating in the reverse direction exerts a function providing the front edge of the sheet in a certain position. When the LF motor 42 rotates in the forward direction in the intermittent feeding mode, the sheet is sent to the printing region 210 by the pair of feed-in rollers 20*a*, 20*b*. In this state, the sheet slides with respect to the supply roller 7.

In the continuous feeding mode, the LF motor 42 rotates in the forward direction, the supply roller 7 rotates in the direction of taking out the sheet from the cassette and sending it to the sheet guide 9, and the feed-in drive roller 20*a* rotates in a direction of sending the sheet to the printing region 210.

As described above, the torque of the LF motor 42 is transmitted to the feed-in drive roller 20*a* via deceleration gear 43*b*. The gear 101 is fixed to a right end section of the feed-in drive roller 20*a* (upper section of the maintaining mechanism 36). A switching gear 102, which is always engaged with the gear 101, is provided at a position adjacent to the gear 101. The switching gear 102 is slidable with respect to a spindle 103 extending in the Y-axis direction.

A first block 104 (first slider) and a second block 105 (second slider) are slidable with respect to the spindle 103. The switching gear 102, first block 104, and second block 105 are slidable with respect to the spindle 103 independently of other members. The first block 104 contacts with or separates from the switching gear 102. The second block 105 contacts with or separates from the first block 104. The switching gear 102 and the first block 104 are rotatable with respect to the spindle 103, and the second block 105 is prohibited to rotate with respect to the spindle 103.

A surface with which the first block 104 and the second block 105 contact is inclined to the spindle 103. When the second block 105 approaches the first block 104, the first block 104 rotates around the spindle 103. An abutting piece 104*a* protruding upward is fixed to the first block 104. When the second block 105 approaches the first block 104 and the first block 104 rotates around the spindle 103, the abutting piece 104*a* moves from top to bottom, in FIG. 11.

As shown in FIG. 29 through FIG. 32, a plate-like engaging plate 104*b* is provided between a base section 104*c* of the first block 104 and the abutting piece 104*a* extending from the base section 104*c* in a radial outer direction. In the second block 105, a section facing the engaging plate 104*b* in the base section 105*a* is provided with a notch section 105*b* in which the engaging plate 104*b* is buried. One surface of the notch section 105*b* is formed as an abutting surface 105*c* inclining from the center of radius of the base section 105*a* to the outside the radius of same. Further, the second block 105 is provided with a pair of corner sections 105*d* extending in the radial outer direction from the base section 105*a*. The pair of corner sections 105*d* is provided so as to be able to abut on a bottom surface of the guide plate 41 on the downstream side so that the second block 105 does not rotate around the spindle 103. The base section 104*c* of the first block 104 is formed so as to be buried in an inner diameter of the base section 105*a* of the second block 105.

Figure 30:
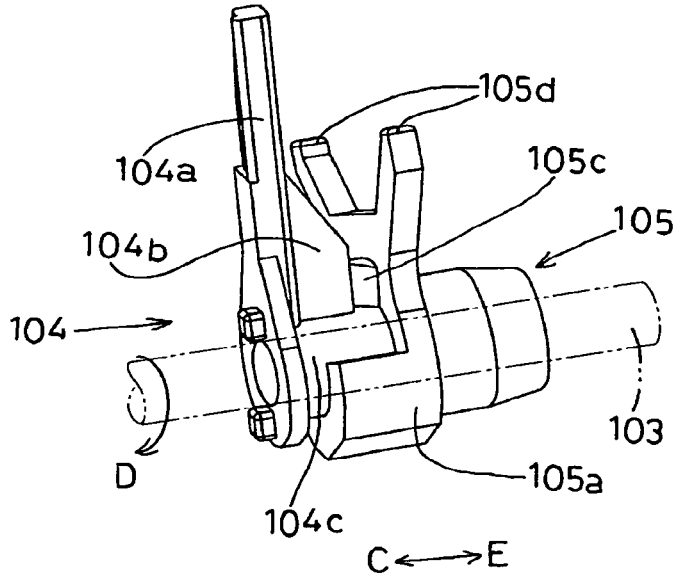
FIG. 30 is a perspective view in which the first block and the second block are combined.
Figure 31:
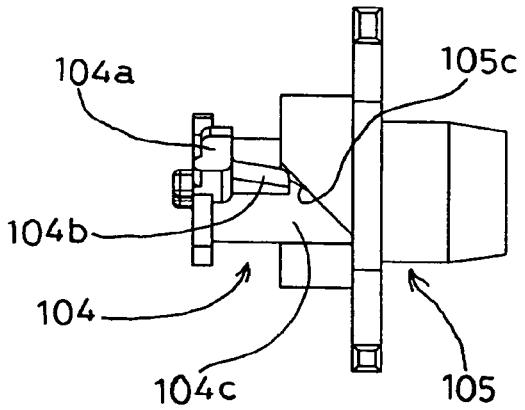
FIG. 31 is a front view in which the first block and the second block are shallowly geared with each other.
Figure 32:
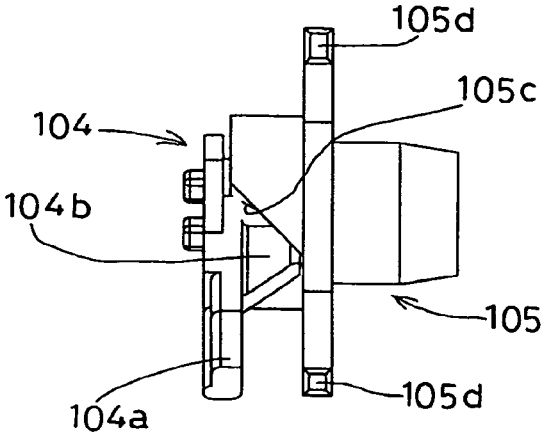
FIG. 32 is a front view in which the first block and the second block are deeply geared with each other.
Figure 33:
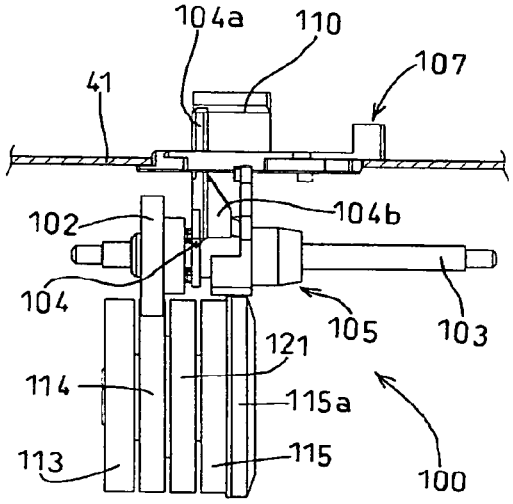
FIG. 33 is a front view showing power transmission in the continuous feeding mode (second mode) when a sheet is fed.
Figure 34:
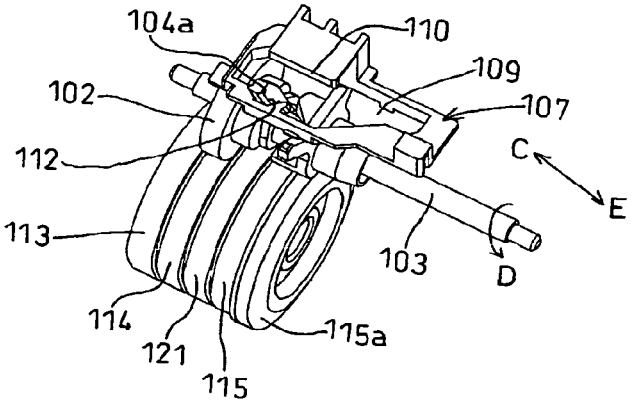
FIG. 34 is a perspective view showing power transmission in the continuous feeding mode (second mode) when a sheet is fed.
Figure 35:
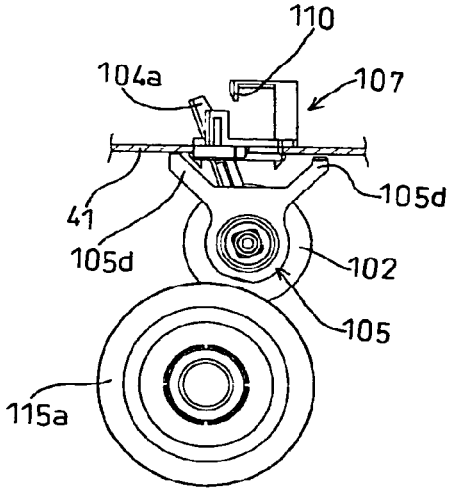
FIG. 35 is a side view showing power transmission in the continuous feeding mode (second mode) when a sheet is fed.
Figure 36:
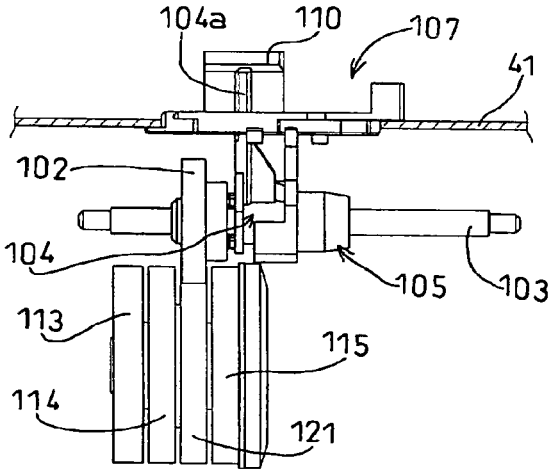
FIG. 36 is a front view showing power transmission in a state in which a sheet is supplied by the second supply unit.
Figure 37:
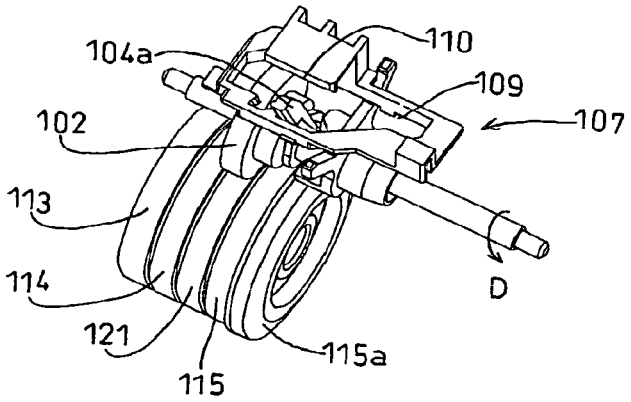
FIG. 37 is a perspective view showing power transmission in a state in which a sheet is supplied by the second supply unit.
Figure 38:
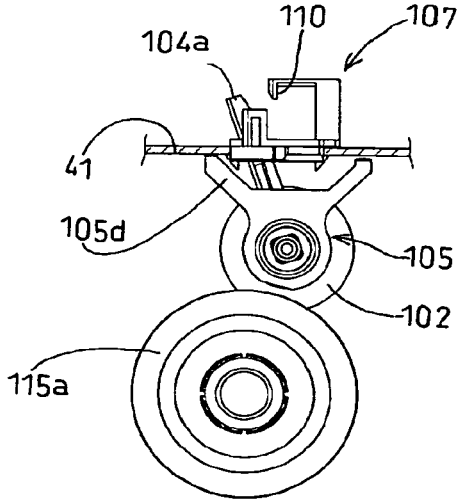
FIG. 38 is a side view showing power transmission in a state in which a sheet is supplied by the second supply unit.
Figure 39:
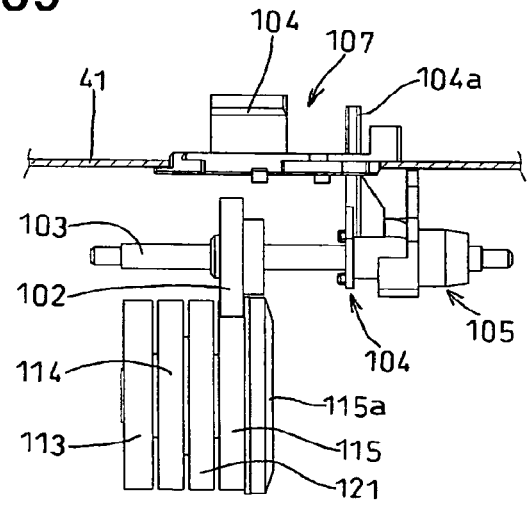
FIG. 39 is a front view showing power transmission in a maintenance operation mode.
Figure 40:
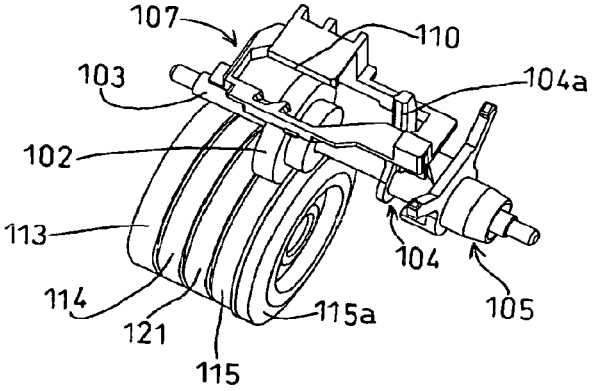
FIG. 40 is a perspective view showing power transmission in the maintenance operation mode.
Figure 41:
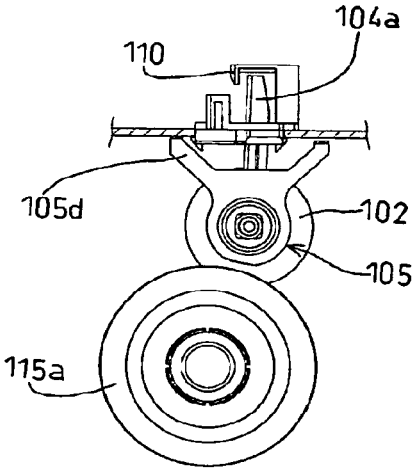
FIG. 41 is a side view showing power transmission in the maintenance operation mode.

During a period between a state where the first block 104 and the second block 105 approach each other and the engaging plate 104*b* abuts against a section on the outer radius side in the abutting surface 105*c* of the notch section 105*b* (see FIG. 31) and a state where the space between the first block 104 and the second block 105 becomes narrow and the engaging plate 104*b* abuts against a section on the center side of the radius in the abutting surface 105*c* of the notch section 105*b* (see FIG. 32), the position of the first block 104 is forcibly caused to rotate in the direction of the arrow D (see FIG. 30). If the first block 104 rotates, the abutting piece 104*a* also rotates. When the first block 104 rotates in the direction of the arrow D, the abutting piece 104*a* moves from top to bottom in FIG. 11.

As shown in FIG. 10, a first biasing spring 106*a* is disposed around the spindle 103. The first biasing spring 106*a* presses the second block 105 in the direction of the arrow C. A second biasing spring 106*b* is disposed around the spindle 103. The second biasing spring 106*b* presses the switching gear 102 in the direction of the arrow E. The biasing force of the first biasing spring 106*a* is larger than the biasing force of the second biasing spring 106*b*.

Figure 11:
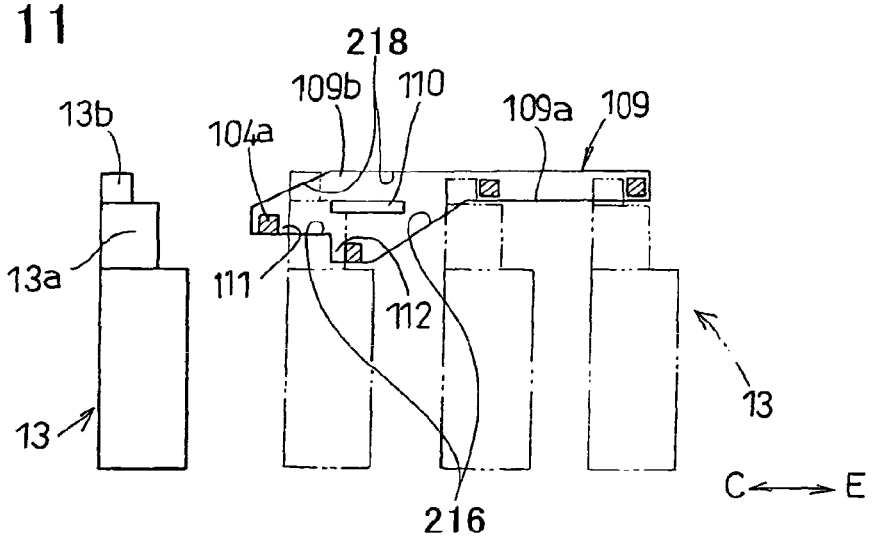
FIG. 11 is a front view showing a state in which modes are switched by the power transmission switching means.

As shown in FIG. 11, a first engaging step section 13*a* and a second engaging step section 13*b* are formed in the carriage 13. When the carriage 13 moves in the direction of the arrow E, the abutting piece 104*a* of the first block 104 is engaged with either the first engaging step section 13*a* or the second engaging step section 13*b*.

As shown in FIG. 8, a guide block 107 is fixed to the frame 39. A guide groove 109 is formed in the guide block 107, and the abutting piece 104*a* of the first block 104 is buried in the guide groove 109. As shown in FIG. 11, the guide groove 109 comprises a horizontal groove section 109*a* which is elongated in the direction indicated by the arrows C and E (Y axis), and an inclined groove section 109*b* which is communicated with a left end section of the horizontal groove section 109*a*. A regulating piece 110 which extends downward from an upper section of the guide block 107 is inserted in a central section of the inclined groove section 109*b*. The regulating piece 110 is elongated in the direction indicated with the arrows C and E. The inclined groove section 109*b* is provided with a stair-like first set section 111 and second set section 112. A first wall 216, which is provided with the first set section 111 and second set section 112, and a second wall 218 extending to the opposite side are formed on the inclined groove section 109*b*. The first set section 111 and the second set section 112 are formed on the first wall 216, while no set section is formed on the second wall 218.

As shown in FIG. 11, when the carriage 13 is located in a position facing the sheet P, the carriage 13 is away from the maintaining mechanism 36 and does not press the abutting piece 104*a* in the direction of the arrow E. In this state, the first biasing spring 106*a* causes the second block 105, first block 104 and switching gear 102 to slide along the spindle 103 in the direction of the arrow C. The abutting piece 104*a* is positioned at the first set section 111. This position is called "position 1" (Po1). At this moment, the switching gear 102 is engaged with the intermittent feeding gear 113.

When the carriage 13 moves in the direction of the arrow E, the first engaging step section 13*a* of the carriage 13 presses the abutting piece 104*a* in the direction of the arrow E. As a result, the switching gear 102, the first block 104, and the second block 105 are caused to slide along the spindle 103 in the direction of the arrow E. Since the first block 104 is pressed by the second block 105 from the right side, the abutting piece 104*a* is pressed against a lower wall (first wall 216) of the inclined groove 109*b*. When the carriage 13 presses the abutting piece 104*a* up to the position corresponding to the second set section 112, the abutting piece 104*a* is moved down to enter the second set section 112. The position where the abutting piece 104*a* enters the second set section 112 is called "position 2" (Po2). In the case of the position 2, the switching gear 102 is engaged with the continuous feeding gear 114. This state is shown in FIG. 10.

When the carriage 13 further moves in the direction of the arrow E, the first engaging step section 13*a* of the carriage 13 presses the abutting piece 104*a* in the direction of the arrow E. The pressed abutting piece 104*a* proceeds to the horizontal groove section 109*a* from the inclined groove section 109*b*. Once the abutting piece 104*a* enters the horizontal groove section 109*a*, the second engaging step section 13*b* of the carriage 13 presses the abutting piece 104*a*. When the abutting piece 104*a* is in the position immediately after entering the horizontal groove section 109*a* (this position is called "position 3" (Po3)), the switching gear 102 is engaged with the maintenance gear 115.

The switching gear 102, intermittent feeding gear 113, continuous feeding gear 114 and maintenance gear 115 are all spur gears, and a bevel gear 115*a* having a large diameter is fixed to a side surface of the maintenance gear 115. When the carriage 13 further moves from the position 3 (Po3) in the direction of the arrow E, a side surface of the switching gear 102 abuts on the bevel gear 115*a*, whereby the switching gear 102 is inhibited from moving any further in the direction of the arrow E and thus continues to be engaged with the maintenance gear 115. The abutting piece 104*a* is pressed by the second engaging step section 13*b* of the carriage 13 and then positioned at a back end section of the horizontal groove section 109*a* (right end section shown in FIG. 11 and FIG. 12). This position is called "position 4" (Po4) and is a home position (original position). In this state, the switching gear 102 and the first block 104 are separated from each other.

Contrary to the above state, when the carriage position 13 moves from the position 4 (Po4) in the direction of the arrow C, the abutting piece 104*a* moves from the horizontal groove section 109*a* to the inclined groove section 109*b*. At this moment, the abutting piece 104*a* is received by a step between the first engaging step section 13*a* and the second engaging step section 13*b* of the carriage 13, thus the abutting piece 104*a* moves above the regulating piece 110 of FIG. 11 in the direction of the arrow C. The abutting piece 104*a* abuts on a left inclined surface of the inclining groove section 109*b* shown in FIG. 11 while sliding on the regulating piece 110, thereafter moves along the left inclined surface (second wall 218) and then is engaged with the first set section 111. A set section does not exist on an upper wall (second wall 218) of the guide groove 109, thus the abutting piece 104*a* moves from the position 4 to the position 1.

After the carriage 13 moves to the right end in the E direction and then moves in the C direction, the abutting piece 104*a* moves from the position 1 to the position 2, from the position 2 to the position 3, from the position 3 to the position 4, and from the position 4 to the position 1. The carriage 13 repeats the movement of moving to the right end in the E direction and then moving in the C direction, while the abutting piece 104*a* repeats the cycle of moving from the position 1→2→3→4→1. When the carriage 13 moves in the E direction to the position 1 and then in the C direction, the switching gear 102 is held at the position 1. When the carriage position 13 moves to the position 2 in the E direction and then in the C direction, the switching gear 102 is held in the position 2.

The position 3 (Po3) is both stand-by position and maintenance position. In a state where power is not applied to the multifunction device 1, the carriage 13 stops at an upper position of the maintaining mechanism 36 and the power transmission switching means 100 is at the position 3. When the power transmission switching means 100 is at the position 3, the maintenance gear 115 is geared with the feed-in drive roller 20*a* via the switching gear 102. When the LF motor 42 rotates in this state, the cap section 36*a* of the maintaining mechanism 36 rises and covers the nozzle surface of the printing head 12 from below. Accordingly, the ink is prevented from drying in the nozzles of the printing head 12. Moreover, the maintaining mechanism 36 is provided with a suction pump (not shown), and when the LF motor 42 rotates in the state where the power transmission switching means 100 is at the position 3 and the maintenance gear 115 is geared with the feed-in drive roller 20*a* via the switching gear 102, the LF motor 42 activates the suction pump. When the suction pump of the maintaining mechanism 36 is activated, air bubbles which are mixed in the buffer tank provided on the printing head 12 are removed, thus the ability of discharging the ink from the nozzles is maintained.

Figure 13:
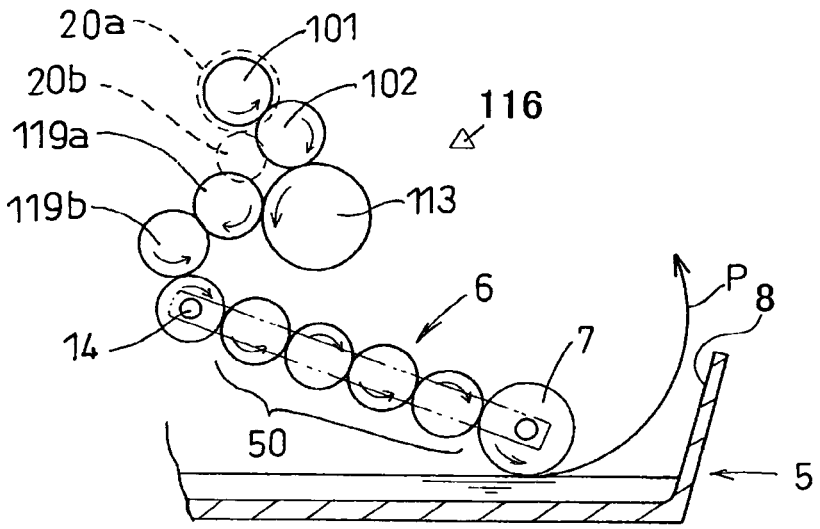
FIG. 13 is a figure showing power transmission in an intermittent feeding mode (first mode) when a sheet is fed.
Figure 14:
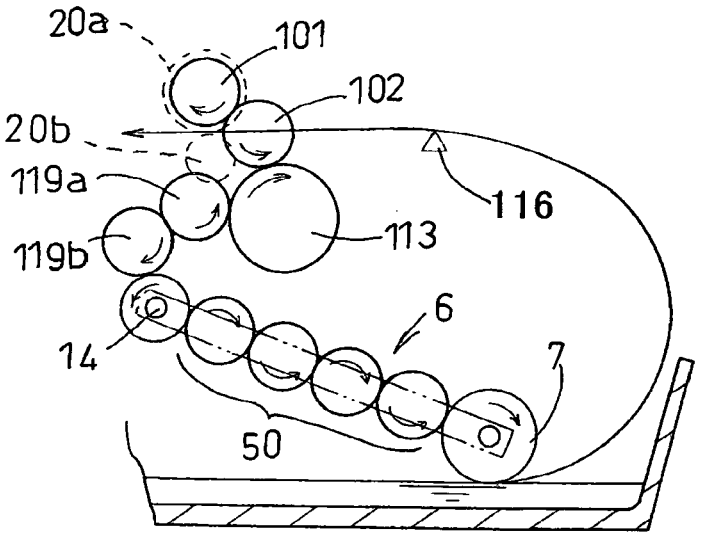
FIG. 14 is a figure showing power transmission in the intermittent feeding mode at the time of printing.

The position 1 (Po1) where the switching gear 102 is geared with the intermittent feeding gear 113 is configured such that, as shown in FIG. 13 and FIG. 14, the torque of the LF motor 42 is transmitted to the drive shaft 14 provided at a rear end of the arm 6; via two intermediate gears 119*a* and 119*b*, and the supply roller 7 is rotated via the gear train 50. In this state, when the LF motor 42 rotates in the reverse direction, the supply roller 7 rotates in the forward direction.

Figure 15:
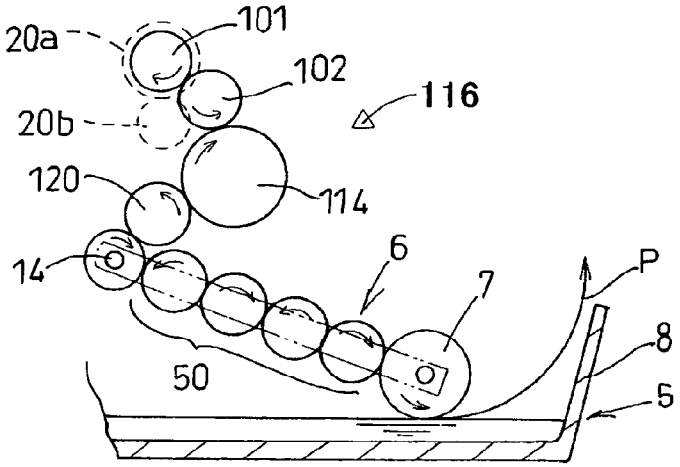
FIG. 15 is a figure showing power transmission in a continuous feeding mode (second mode) when a sheet is fed.
Figure 16:
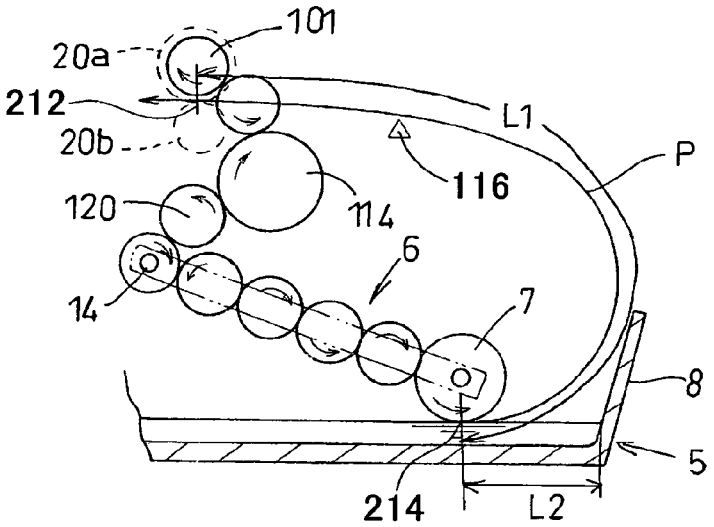
FIG. 16 is a figure showing power transmission in the continuous feeding mode at the time of printing.
Figure 17:
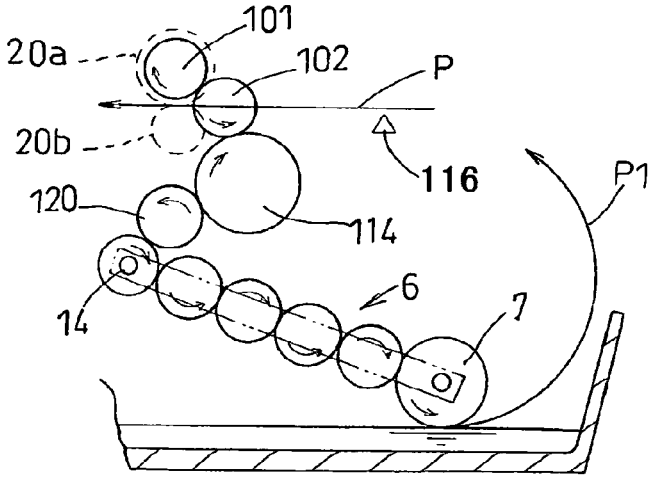
FIG. 17 is a figure showing power transmission in the continuous feeding mode when feeding a subsequent sheet P1.

The position 2 (Po2) where the switching gear 102 is geared with the continuous feeding gear 114 is configured such that, as shown in FIG. 15 through FIG. 17, the torque of the LF motor 42 is transmitted to the drive shaft 14 provided at the rear end of the arm 6; via one intermediate gear 120, and the supply roller 7 is rotated via the gear train 50. In this state, when the LF motor 42 rotates in the forward direction, the supply roller 7 rotates in the forward direction.

Figure 5:
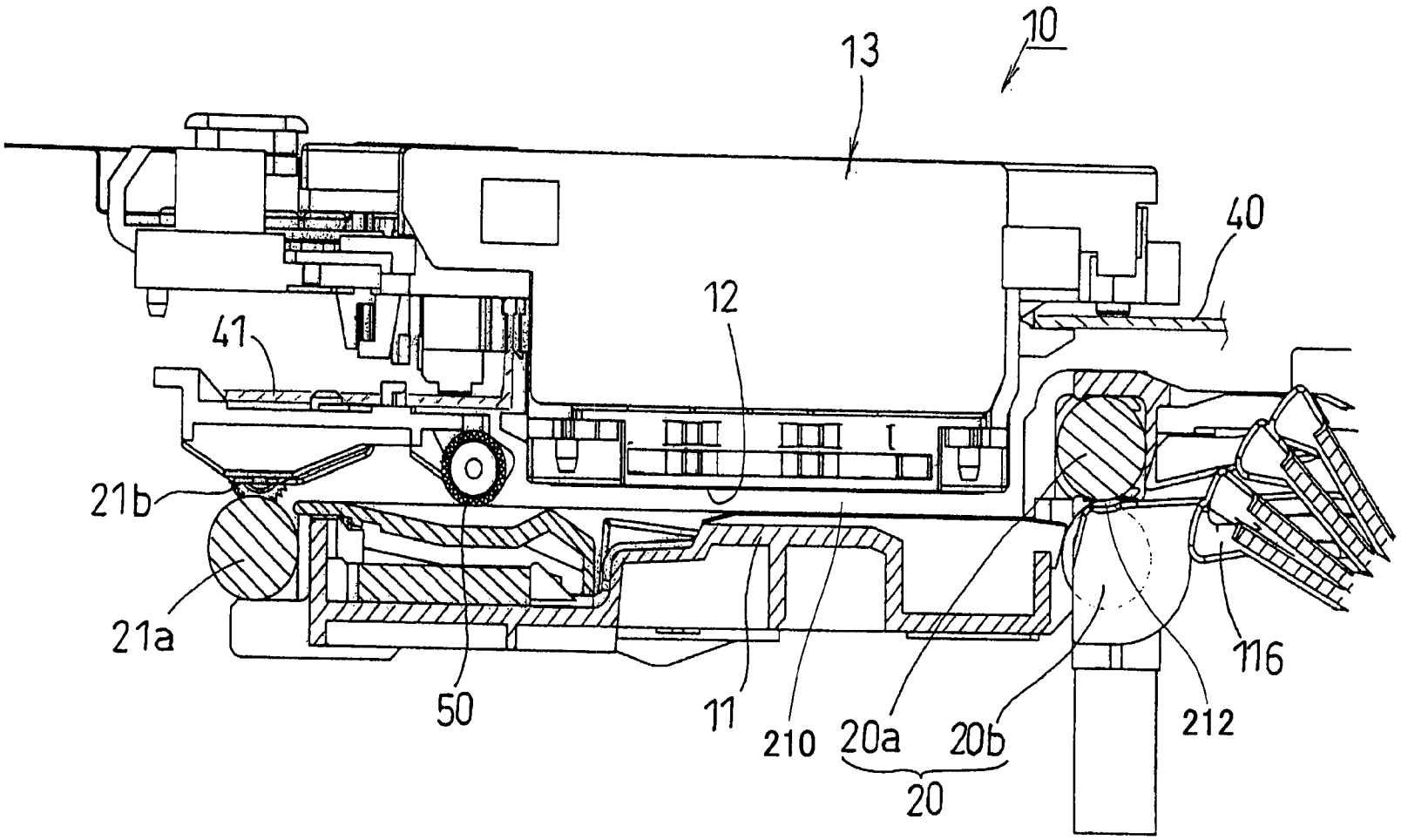
FIG. 5 is a cross-sectional view showing an enlarged side view in the vicinity of a printing region.

As shown in FIG. 5, a roller 50 is disposed between the printing head 12 and the feed-out rollers 21*a*, 21*b*. The roller 50 presses the sheet P against the platen 11. Since the roller 50 is provided, the sheet P is not brought into contact slidingly with the nozzle surface of the printing head 12, thus the sheet P is prevented from being stained.

Furthermore, a sheet sensor 116 for sensing the presence of the sheet P is provided on an upstream side of the feed-in rollers 20*a*, 20*b*. The sheet sensor 116 detects a point of time at which the front edge of the sheet P reaches the sheet sensor 116 and a point of time at which the back edge of the sheet P separates from the sheet sensor 116.

Figure 20:
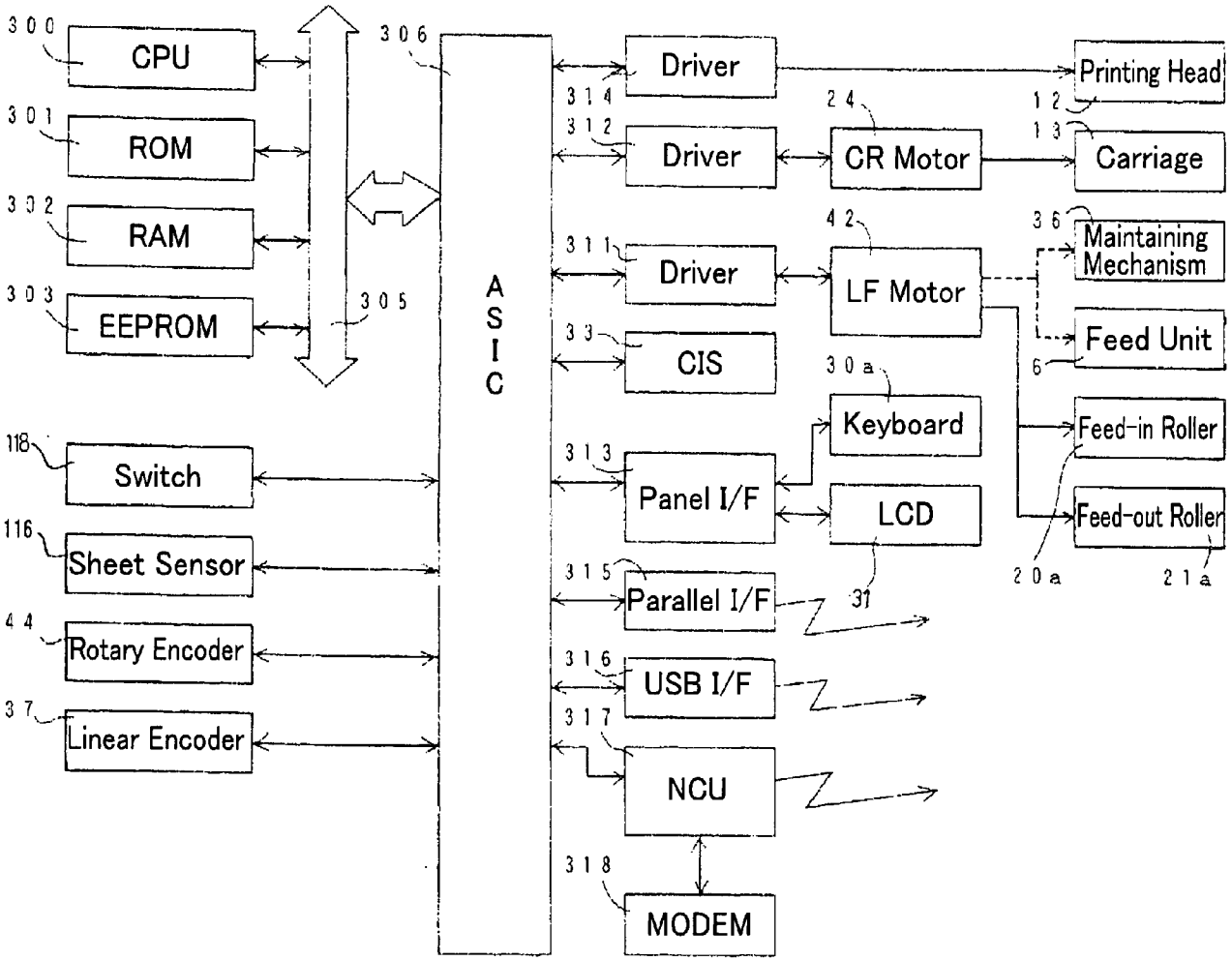
FIG. 20 is a functional block diagram of a control unit.

A control section (control means) of the multifunction device 1 is described next with reference to FIG. 20. The control section is for controlling the entire operation of the multifunction device 1.

The control section is configured as a computer comprising mainly as a CPU 300, ROM 301, RAM 302, and EEPROM 303, and is connected to an application specific integrated circuit (ASIC) 306 via a bus 305.

The ROM 301 has stored therein a program and the like for controlling various operations of the multifunction device 1, and the RAM 302 is used as a storage region for temporarily storing various data items which are used when the CPU 300 executes these programs.

An NCU (Network Control Unit) 317 is connected to the ASIC 306, and a communication signal which is inputted from a public circuit via the NCU 317 is demodulated by a MODEM 318 and then inputted to the ASIC 306. Furthermore, when the ASIC 306 transmits image data to the outside by means of facsimile transmission or the like, the image data is modulated by the MODEM 318 and then outputted to the public line via the NCU 317.

The ASIC 306 generates a phase excitation signal and the like which are communicated with, for example, the LF motor 42 in accordance with a command from the CPU 300. These signals are provided to a drive circuit 311 of the LF motor 42 or a drive circuit 312 of the CR motor 24, and a drive signal is communicated to the LF motor 42 or CR motor 24 via the drive circuit 311 or drive circuit 312 to control forward and reverse operation, stoppage and the like of the LF motor 42 and CR motor 24.

Further, the scanner device 33 (CIS, for example) for reading images or characters on a script, a panel interface 313 for performing transmission of signals with a keyboard 30*a* and a liquid crystal display (LCD) 31 of the operation panel 30, a parallel interface 315 for performing transmission of data with external equipment such as a personal computer via a parallel cable or USB cable, a USB interface 316, and the like are connected to the ASIC 306.

Moreover, a switch 118 for detecting a rotation position of a cam (not shown) of the maintaining mechanism 36, the sheet sensor 116 for detecting the front edge position and the back edge position of the sheet P when the sheet P is fed so as to approach the printing region 210 via the sheet guide 9, the rotary encoder 44 for detecting the amount of rotation of the feed-in roller 20*a*, the linear encoder 37 for detecting the position (present position) of the carriage 13 in the Y-direction, and the like are connected to the ASIC 306.

A driver 314 is for selectively discharging the ink from the printing head 12 at a predetermined timing. The driver 314 receives a signal, which is generated in the ASIC 306 on the basis of a drive control procedure outputted from the CPU 300 and is then outputted, and drive-controls the printing head 12.

Next, sending of sheets by means of the above control means and control of the printing operation are described with reference to the flowchart shown in FIG. 21. In the control shown in FIG. 21, a pattern of feeding the sheet P is changed to either the first mode or the second mode. In the first mode, a plurality of sheets are sent intermittently to the printing region 210. The first mode is an accurate mode in which printing precision is prioritized. In the second mode, a plurality of sheets is sent to the printing region 210 continuously and sequentially. The second mode is a speedy mode in which the printing speed is prioritized.

When power is applied to the multifunction device 1, control is started. The user presses a mode setting button of the operation panel 30 (not shown) to select either the first mode or the second mode. When the user wishes to print precisely, the first mode is selected. When the first mode is selected, the front edge of a sheet P, which is sent by the supply roller 7, is aligned with a contact line 212 (see FIG. 5) between the pair of feed-in rollers 20*a*, 20*b* rotating in the reverse direction, in which state sending of the sheet P is stopped once. Even if the front edge of the sheet P is sent by the supply roller 7 such that the front edge of the sheet P is inclined with respect to the contact line 212 between the pair of feed-in rollers 20*a*, 20*b*, the front edge of the sheet P is aligned with the contact line 212 between the pair of feed-in rollers 20*a*, 20*b*. In a state where the front edge of the sheet P is aligned with the contact line 212 between the pair of feed-in rollers 20*a*, 20*b*, the pair of feed-in rollers 20*a*, 20*b* starts to send the sheet P toward the printing region 210. This timing is sent to the CPU 300, and the CPU 300 controls the printing head 12 on the basis of this timing. When the first mode (accurate mode) is selected, the front edge of the sheet P is not sent toward the printing region 210 in the inclined state, and the position of the front edge of the sheet P and the control on the printing head 12 are synchronized, whereby a desired graphic pattern is printed on a desired location of the sheet P.

Figure 12:
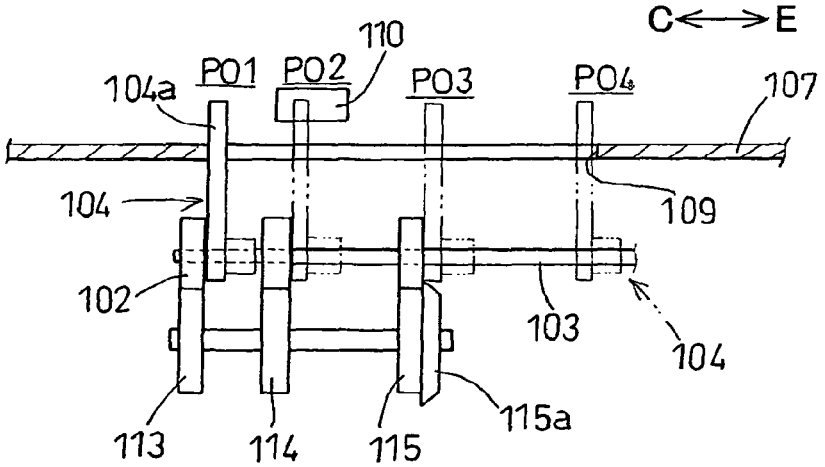
FIG. 12 is a plan view showing a state in which the modes are switched by the power transmission switching means.
Figure 21:
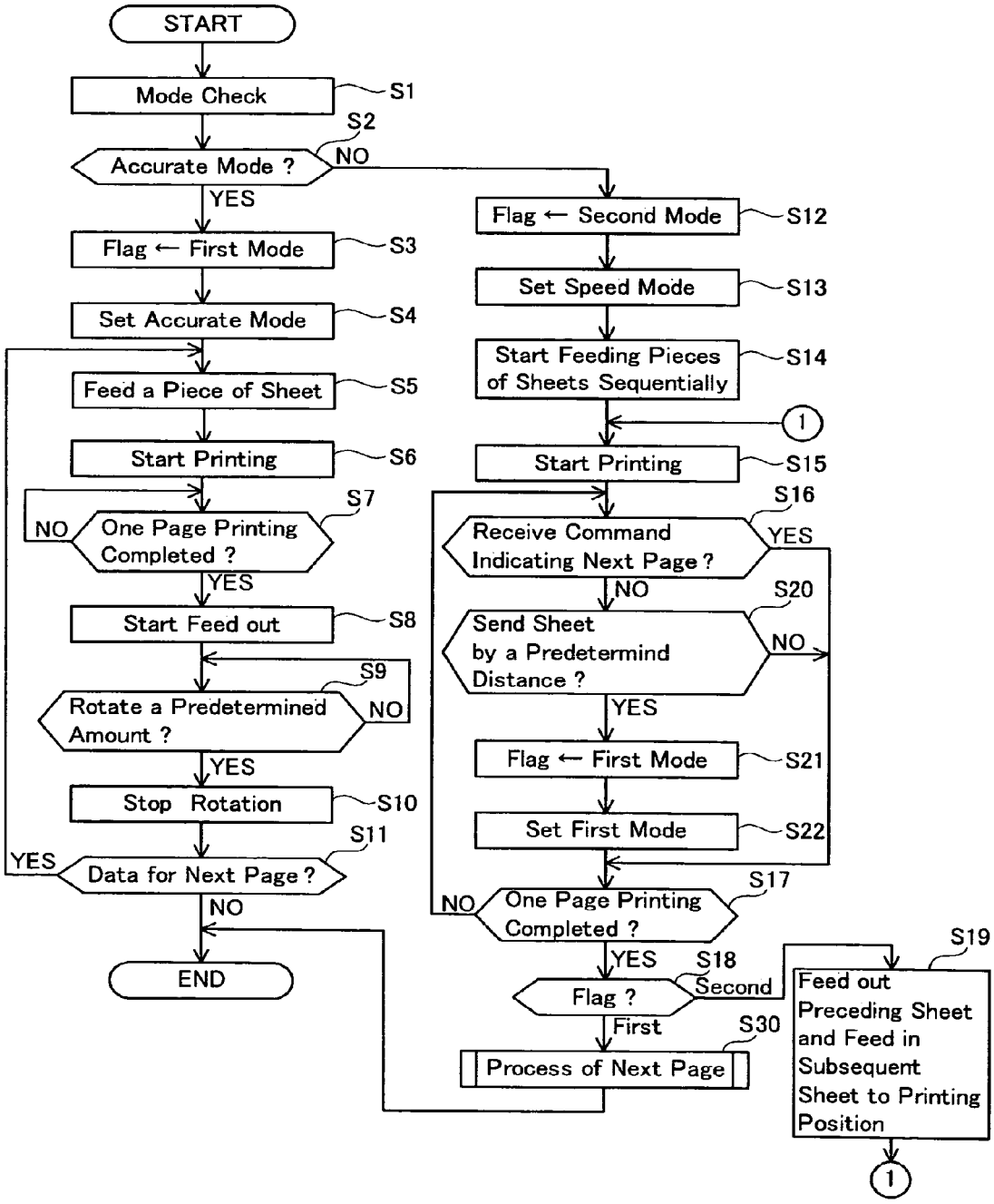
FIG. 21 is a flowchart for controlling the printing operation.

The control section first checks the set mode (S1 in FIG. 21). The control section then determines whether the set mode is the accurate mode (intermittent feeding mode) (S2). If the set mode is the accurate mode (S2: yes), the flag is switched to the first mode (S3), and the power transmission switching means 100 is set to the accurate mode (S4). Specifically, the carriage 13, which is stopped at the stand-by position indicated by the Po3 in FIG. 12, is moved significantly to the printing region 210 in the direction of the arrow C. Accordingly, the first block 104 which is pressed by the biasing spring 106*a* is moved in the direction of the arrow C along the regulating piece 110 inside the inclining groove 109*b* shown in FIG. 11, then received by the first set section 111 and held at this position (position 1 (Po1)). In this state, the switching gear 102 is geared with the intermittent feeding gear 113.

Once the switching gear 102 is geared with the intermittent feeding gear 113, rotation of the feed-in drive roller 20*a* is transmitted to the drive shaft 14 of the supply unit 6 via the intermediate gear 119*a*, 119*b*, as shown in FIG. 13. In this state, when the LF motor 42 is rotated in the reverse direction, the feed-in drive roller 20*a* is rotated in the reverse direction (counterclockwise direction in FIG. 13). On the other hand, the supply roller 7 is rotated in the forward direction (counterclockwise direction in FIG. 13) by the gear train 50 inside the arm 6*a*. When the supply roller 7 is rotated in the forward direction, the plurality of sheets P, which are stacked on the paper cassette 5, are caused to abut on a separating member (not shown) of the separating inclined surface 8 provided at the front edge of the paper cassette 5, the separating member having a high frictional coefficient. Then, only one uppermost sheet P is taken out from the paper cassette 5 and sent toward the sheet guide 9 (S5 in FIG. 21). At this moment, since the feed-in roller 20*a* is rotated in the reverse direction (counterclockwise direction in FIG. 4), the sheet P which is sent by the supply roller 7 cannot pass through between the feed-in drive roller 20*a* and the feed-in driven roller 20*b*. The front edge of the sheet P is aligned with the contact line 212 (see FIG. 5) between the pair of feed-in rollers 20*a*, 20*b*. Even if the front edge of the sheet P sent by the supply roller 7 is inclined, the front edge of the sheet P is aligned with the contact line 212 between the pair of feed-in rollers 20*a*, 20*b*.

Next, as shown in FIG. 14, the LF motor 42 rotates in the forward direction through an appropriate number of steps, the feed-in drive roller 20*a* rotates in the forward direction (clockwise rotation in FIG. 14), and the sheet P between the feed-in drive roller 20*a* and the feed-in driven roller 20*b* is sent toward the printing region 210. The sheet P is sent by a predetermined distance after the LF motor 42 started rotation in the forward direction. As a result, the front edge of the sheet P is set at a print starting position inside the printing region 210. This process is called "heading process".

The supply roller 7 rotates in the reverse direction (clockwise direction in FIG. 14) during the heading process. However, since the power of the feed-in drive roller 20*a* and the feed-in driven roller 20*b* sending the sheet P is set larger than the power of the supply roller 7 sending the sheet P, the sheet P is sent by the pair of feed-in rollers 20*a*, 20*b*, and the arm 6*a* is oscillated in the counterclockwise direction around the drive shaft 14. When the arm 6*a* is oscillated in the counterclockwise direction around the drive shaft 14, the power for pressing the sheet against the supply roller 7 weakens, thus the power for sending the sheet is not transmitted to the sheet even when the supply roller 7 is rotated. The sheet is caused to slide with respect to the supply roller 7 and released from the supply roller 7.

Subsequently, when a printing command is inputted from an external computer or the like, which is not shown, the carriage 13 is caused to move in the Y-direction and at the same time the ink is discharged from the nozzles of the printing head 12 onto a surface of the sheet P to print a graphic pattern thereon (S6 in FIG. 21). While the carriage 13 moves in the Y-direction, the supply roller 7, the feed-in rollers 20*a*, 20*b* and the feed-out rollers 21*a*, 21*b* are stopped, therefore, the sheet P is stopped. When the carriage moves from one end to the other end in the Y-direction, and a printing operation along a single path of the carriage is completed, the feed-in rollers 20*a*, 20*b* and the feed-out rollers 21*a*, 21*b* are rotated in the forward direction by the predetermined distance, which is equal to a length of the printing region along X axis printed by the single path of the carriage. Movement of the carriage 13 and rotation of the feed-in rollers 20*a*, 20*b* and the feed-out rollers 21*a*, 21*b* are performed alternately.

When the feed-in rollers 20*a*, 20*b* and the feed-out rollers 21*a*, 21*b* are rotated in the forward direction during the heading operation or printing operation, the drive shaft 14 is rotated in the reverse direction, and the arm 6*a* is oscillated upward. The power for pressing the sheet against the supply roller 7 weakens, thus the power for sending the sheet is not transmitted from the supply roller 7 to the sheet. Although the supply roller 7 rotates in a reverse direction while the feed-in rollers 20*a*, 20*b* and the feed-out rollers 21*a*, 21*b* rotate in the forward direction, the sheet is caused to slide with respect to the supply roller 7 and the sheet P is sent in the forward direction.

In this heading process, the front edge of the sheet P was aligned with the contact line 212 between the pair of feed-in rollers 20*a*, 20*b* when the LF motor 42 started the forward rotation. Therefore the position of the front edge of the sheet P during the forward rotation of the pair of feed-in rollers 20*a*, 20*b* is determined from elapsed time since the timing when the pair of feed-in rollers 20*a*, 20*b* started the forward rotation. When the operation of the printing head 12 is controlled based on that timing, the position of the front edge of the sheet P and the operation of the printing head 12 are synchronized, whereby a desired graphic pattern is printed on a desired location of the sheet P.

When printing one page is finished (S7 in FIG. 21: yes), feeding out of the printed sheet P is started (S8 in FIG. 21). In doing so, the LF motor 42 rotates in the forward direction through the number of steps (S9 in FIG. 21: yes), and then the rotation of the LF motor 42 is stopped (S10 in FIG. 21). As a result, feed-in rollers 20*a*, 20*b* and the feed-out rollers 21*a*, 21*b* rotate a predetermined number of times in a direction of sending the sheet and then stops. The printed sheet P is sent out to the upper position in the cassette 5.

Next, it is determined whether printing data for a sheet (next page), which is described hereinafter, is present or not (S11). If the print data exists or is stored (S11 in FIG. 21: yes), the process from the step S5 through S11 is repeated. In this manner, the sheets P are sent to the printing region 210 one by one. In this mode, a color picture, for example, can be printed accurately.

Next, a case in which the second mode is set is explained. When the user needs printing at high speed, the second mode is set.

When it is determined in the step S2 in FIG. 21 that the set mode is not the first mode, the flag is set to the second mode (S12 in FIG. 21). Specifically, the flag showing the second mode is stored in a predetermined region inside the RAM 302. Next, the power transmission switching means 100 is set to the second mode (S13). In the second mode, the quality of a print it not important, but the printing speed is prioritized, thus a plurality of sheets P are continuously and sequentially sent to the printing region 210. Therefore, the power of the feed-in roller 20*a* and the feed-in roller 20*b* sending the sheets is set larger than the power of the supply roll 7 sending the sheets, and the circumferential speed of the feed-in roller 20*a* is set higher than the circumferential speed of the supply roller 7. The speed reduction ratio between the continuous feeding gear 114 and the intermediate gear 120 shown in FIG. 15 through FIG. 17 is set such that the circumferential speed of the feed-in roller 20*a* is higher than the circumferential speed of the supply roller 7.

In order to set the power transmission switching means 100 to the second mode (S13 in FIG. 21), the carriage 13 is moved a predetermined amount in the direction of the arrow E, as shown in FIG. 12. Accordingly, as shown in FIG. 11, the abutting piece 104*a* is pressed in the E direction at the first engaging step section 13*a* of the carriage 13. The abutting piece 104*a* is positioned at the second set section 112 (position 2, Po2) while moving the carriage 13 in the direction of the arrow E. By positioning the abutting section 104*a* at the second set section 112 (position 2, Po2), even if the carriage 13 is moved in the direction of the arrow C thereafter, the abutting piece 104*a* can be held at the second set section 112. During the period in which the abutting piece 104*a* is positioned at the second set section 112, the switching gear 102 and the continuous feeding gear 114 are geared with each other, as shown in FIG. 15 through FIG. 17, and the power is transmitted to the drive shaft 14 of the rear end of the arm 6*a* via one intermediate gear 120.

As shown in FIG. 15, when the LF motor 42 rotates in the forward direction in order to start feeding a sheet P, the feed-in drive roller 20*a* rotates in the forward direction (clockwise direction in FIG. 15), and the supply roller 7 also rotates in the forward direction. The supply roller 7 separates only one uppermost sheet P and sends it to the sheet guide 9 (S14 in FIG. 21). When the front end section of the sheet P reaches the contact line 212 between the feed-in drive roller 20*a* and the feed-in driven roller 20*b*, the front end of the sheet P is drawn into between the feed-in drive roller 20*a* and the feed-in drive roller 20*b* since the feed-in roller 20*a* is rotated in the forward direction, and is then sent toward the printing region 210.

When one piece of sheet P is held between the pair of feed-in rollers 20*a*, 20*b* and is in contact with the supply roller 7 (see FIG. 16), since the power of the pair of feed-in rollers 20*a*, 20*b* sending the sheet is set larger than the power of the supply roller 7 sending the sheet, and the circumferential speed of the feed-in drive roller 20*a* is set higher than the circumferential speed of the supply roller 7, thus the sheet P is sent toward the printing region 210 at the sending speed of the feed-in roller 20*a*. The sheet P slides with respect to the supply roller 7. Since the preceding sheet is sent by the pair of feed-in rollers 20*a*, 20*b* with faster speed, and the subsequent sheet is sent by the supply roller 7 with slower speed, there is provided a space between the preceding sheet and the subsequent sheet when the preceding sheet and the subsequent sheet reach the pair of feed-in rollers 20*a*, 20*b*.

In the continuous feeding mode, the printing operation onto the sheet P (S15 in FIG. 21) is started when the amount of rotation of the pair of feed-in rollers 20*a*, 20*b* reaches a predetermined amount after the front edge of the sheet P is sensed by the sheet sensor 116. When the pair of feed-in rollers 20*a*, 20*b* rotates by the predetermined amount after the sheet sensor 116 detected the front edge of the sheet P, the pair of feed-in rollers 20*a*, 20*b* stops rotation. At this timing the sheet is located at a print start position. The printing operation is stared (S15 in FIG. 21) when the sheet is adjusted at the print start position.

In the printing operation, the carriage 13 is caused to move in the Y-direction and at the same time the ink is discharged from the nozzles of the printing head 12 onto a surface of the sheet P to print a graphic pattern thereon (S15 in FIG. 21). While the carriage 13 moves in the Y-direction, the supply roller 7, the feed-in rollers 20*a*, 20*b* and the feed-out rollers 21*a*, 21*b* are stopped, therefore, the sheet P is stopped. When the carriage 13 moves from one end to the other end in the Y-direction, and a printing operation along a single path of the carriage is completed, the feed-in rollers 20*a*, 20*b* and the feed-out rollers 21*a*, 21*b* are rotated in the forward direction by the predetermined distance, which is equal to a length of the printing region along X axis printed by the single path of the carriage. Movement of the carriage 13 and rotation of the feed-in rollers 20*a*, 20*b* and the feed-out rollers 21*a*, 21*b* are performed alternately.

Next, when a command indicating that print data to be printed on the next page (subsequent sheet) exists is received from the external device (S16: yes), the process proceeds to S17. In this case, when printing of the preceding sheet P is ended (S17: yes), it is determined whether the current flag is the first mode or the second mode (S18). When the fag is the second mode (S18: second), the LF motor 42 continues to rotate in the forward direction and the feed-in drive roller 20*a*, feed-out drive roller 21*a* and supply roller 7 are continued to rotate in the forward direction (S19). The controller has an additional procedure that starts continuous rotation of the supply roller 7 and the pair of feed-in rollers 20*a*, 20*b* at a timing when printing operation of a preceding sheet is completed (S17). Accordingly, the preceding sheet (preceding page) is discharged, and the following sheet (subsequent page) is conveyed to the print starting position. When the pair of feed-in rollers 20*a*, 20*b* rotates by the predetermined amount after the sheet sensor 116 detected the front edge of the subsequent sheet P, the sheet is positioned at the print starting position. The supply roller 7 and the pair of feed-in rollers 20*a*, 20*b* continues to rotate without stoppage until the pair of feed-in rollers 20*a*, 20*b* rotates by the predetermined amount after the sheet sensor 116 detected the front edge of the sheet P. After this process, the step returns to S15, and printing on the next page (subsequent page) is started.

This continuous rotation of the supply roller 7 and the pair of the feed-in roller makes the printing operation for a plurality of sheets faster. However, it is not essential, and the cyclic change that the supply roller 7 and the feed-in rollers 20*a*, 20*b* rotate and stop alternately may be repeated continuously. In this case, the same cyclic change is repeated while the contact point between the roller and the sheet moves from the front edge of the preceding sheet through the intermediate portion and the back edge of the preceding sheet to the front edge of the subsequent sheet. The same cyclic change of the supply roller 7 and the feed-in rollers 20*a*, 20*b* is repeated while the printing operation for a plurality of sheets is performed in the cautious feeding mode.

FIG. 17 shows a state in which the preceding sheet P is discharged and the following sheet P is conveyed to the print starting position. During the period in which the second mode is set, the plurality of sheets P are continuously and sequentially fed/discharged without temporarily stopping sending of the sheet P by the feed-in drive roller 20*a* and the feed-in driven roller 20*b*, thus high-speed printing process can be performed.

Next, a case in which control is performed when the print data for the subsequent sheet does not exist during execution of the second mode is explained. In step S16 in FIG. 21, when the command indicating that the print data to be printed on the next page exists is not received (S16: no), that is, when the print data for the subsequent sheet P no longer exist, the sheet P (sheet) positioned at the printing region 210 is conveyed a predetermined distance in a feed-out direction (S20). This predetermined distance is approximately three printing lines. When the sheet is sent by the predetermined distance (S20: yes), the flag is switched to the first mode (S21). In this state, printing is executed on the sheet P positioned in the printing region 210 (S17). When this printing operation is ended (S17: yes), the current flag is questioned (S18).

When it is determined in the step S18 that the flag is the first mode (S18: first), the process control is executed on the subsequent sheet (S30). The detail of this control is shown in the flowchart of FIG. 22.

Figure 18:
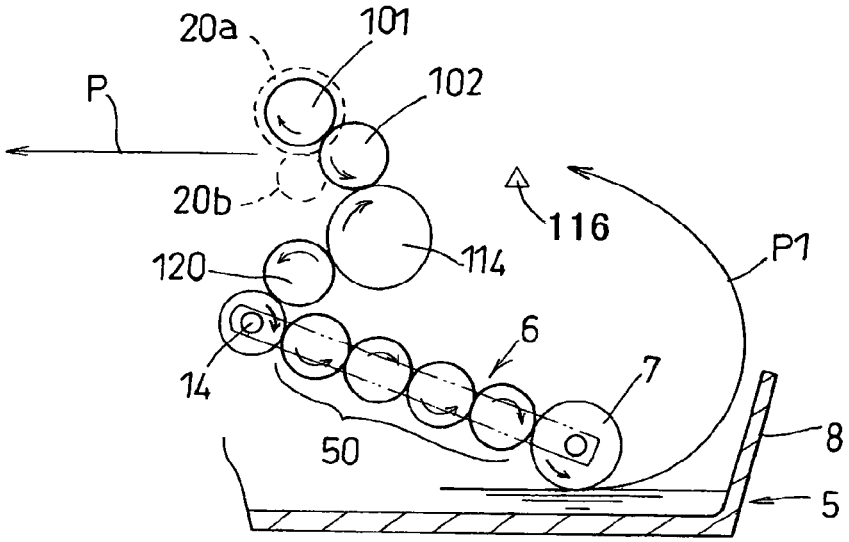
FIG. 18 is a figure showing a first embodiment of a sheet-returning process in the continuous feeding mode.
Figure 22:
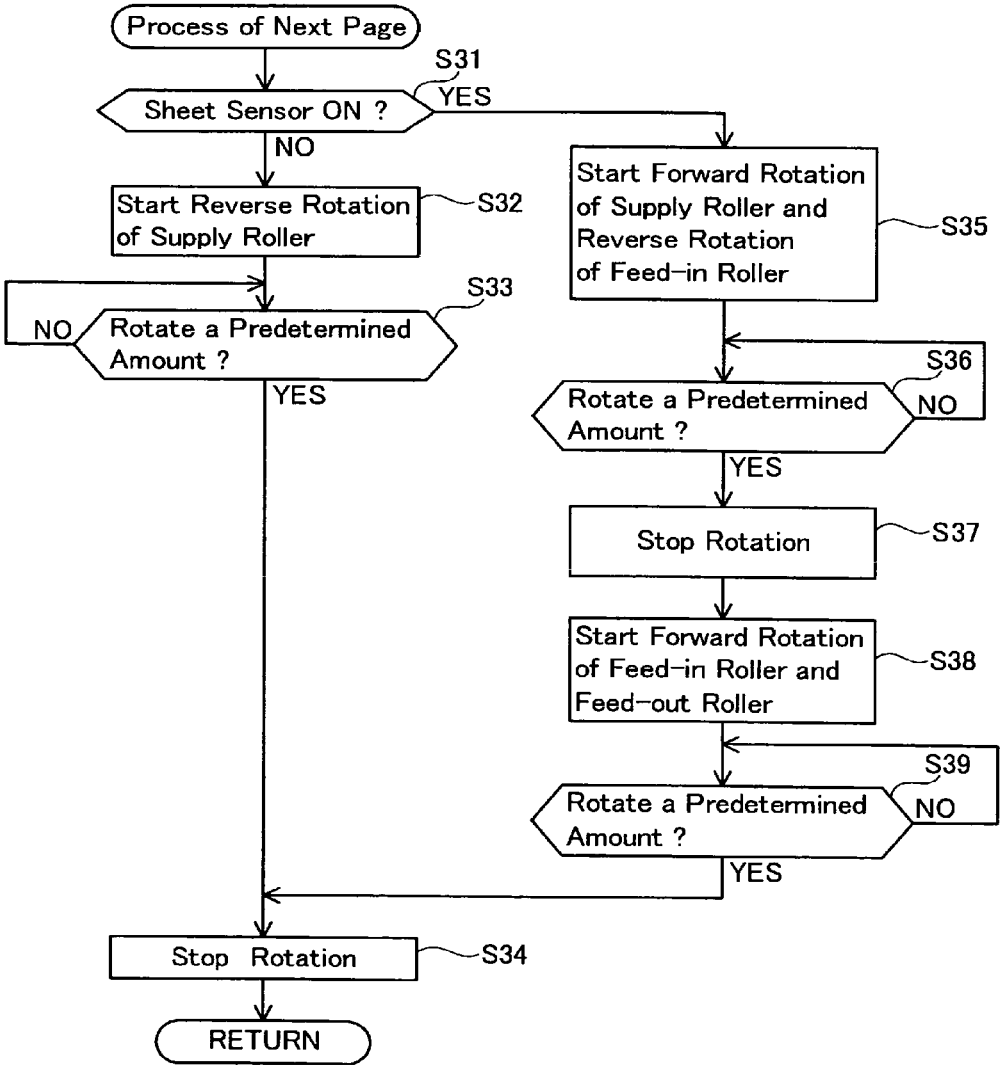
FIG. 22 is a flowchart for controlling of returning a sheet in the continuous feeding mode.

First, at a point of time when the printing of the one page of the preceding sheets P is ended (when the S17 in FIG. 21 is YES), it is determined whether the sheet sensor 116 is ON or not (S31 in FIG. 22). Specifically, it is determined whether the front edge section of the subsequent sheet P passes a section where the sheet sensor 16 exists. When the sheet sensor 116 is OFF (S31: no), that is, when the front edge of the subsequent sheet P does not yet reach the sheet sensor 116 (see FIG. 18), the first half of the subsequent sheet P is positioned within the sheet guide 9 and the last half of this sheet P is positioned within the cassette 5, thus the processing time is reduced if the subsequent sheet P1 is returned to the paper cassette 5. Further, when a sheet P which is not recorded is discharged through the printing region 210, it involves an effort to set the sheet P1 in the paper cassette 5 again, thus it is preferred that the subsequent sheet P1 be returned to the paper cassette 5.

Figure 19:
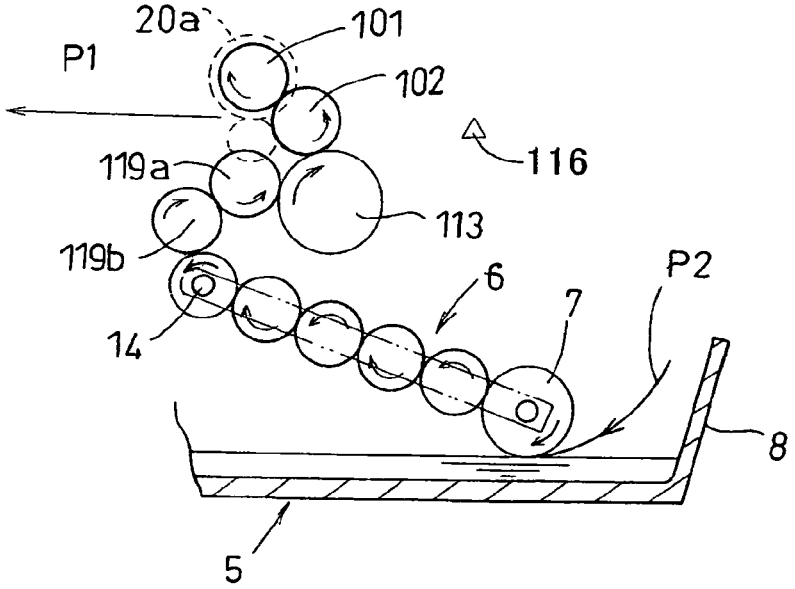
FIG. 19 is a figure showing a second embodiment of the sheet-returning process in the continuous feeding mode.

In the above case, in order to return the subsequent sheet P1 to the paper cassette 5, the supply roller 7 is rotated in the reverse direction (S32 in FIG. 22). In this case, the carriage 13 is moved in the direction of the arrow E in FIG. 12 from the position of the printing region and the abutting piece 114*a* is positioned at the position 1 (Po1). In this position, the switching gear 102 is geared with the intermittent feeding gear 113, as shown in FIG. 14. When the LF motor 42 is rotated in the forward direction, the feed-in drive roller 20*a* and the feed-out driven roller 21*a* are rotated in the forward direction, thus the preceding sheet P is sent in the feed-out direction. On the other hand, the supply roller 7 is rotated in the reverse direction. When the supply roller 7 is rotated a predetermined amount in the reverse direction (S33 in FIG. 22) and then stopped (S34), the subsequent sheet P1 is returned to the stacking position in the paper cassette 5 (see FIG. 19).

At a point of time when printing of one page of the preceding sheet P is ended (when S17 in FIG. 21 is YES), when the sheet sensor 116 is ON (S31 in FIG. 22: yes), the front edge section of the subsequent sheet P1 passes the position where the sheet sensor 116 is present. In this case, the LF motor 42 is rotated in the reverse direction, the supply roller 7 is rotated forward, and the feed-in drive roller 20*a* is rotated in the reverse direction (S35 in FIG. 22). When executing S35 in FIG. 22, the abutting piece 114*a* is positioned at the position 1 (Po1 ) and is in a connection state shown in FIG. 13. In this state, the LF motor 42 is rotated a predetermined amount (S36 in FIG. 22), and the front edge of the subsequent sheet P1 is aligned with the contact line 212 between the feed-in drive roller 20*a* and the feed-in driven roller 20*b*. In this state, the rotation of the LF motor 42 is stopped once and the rotation of the feed-in roller 20*a* and of the supply roller 7 is also stopped (S37 in FIG. 22). Subsequently, by rotating the LF motor 42 in the forward direction and the feed-in drive roller 20*a* and the feed-out drive roller 21*a* are rotated in the forward direction to discharge the sheet P1. In this state, the supply roller 7 is rotated in the reverse direction (see FIG. 19), thus when the supply roller 7 is rotated a predetermined amount in the reverse direction (S39), a subsequent sheet P2 which follows the sheet P1 is returned to the paper cassette 5.

It should be noted that, as shown in FIG. 16, the distance from a contact line 214 between the stacked sheets P on the paper cassette 5 and the supply roller 7 to the contact line 212 between the feed-in drive roller 20*a* and feed-in driven roller 20*b* along the sheet guide 9 is L1, and the distance from the contact line 214 between the stacked sheets P on the paper cassette 5 and the supply roller 7 to the separating member in the separating inclined surface 8 is L2.

In a case of the continuous feeding operation, at the moment when the back edge of a preceding sheet P is removed from the contact line 214 between the sheet P and the supply roller 7, the subsequent sheet P1 is conveyed by the rotation of the supply roller 7, thus the distance L2 becomes a lapping amount (overlapping amount) along the direction of conveyance of the preceding sheet P and a subsequent sheet P1. The difference between the L2 and L1 is set so as t to be longer than a predetermined value, and the difference between the circumferential speed V1 of the feed-in roller 20*a* and the circumferential speed V2 of the supply roller 7 (V1>V2) (V1−V2) is set so as to be at least a predetermined value, whereby when the back edge of the preceding sheet P passes through the contact line 212 between the feed-in drive roller 20*a* and the feed-in driven roller 20*b*, the front edge of the subsequent sheet P1 does not reach the contact line 212 between the feed-in drive roller 20*a* and the feed-in driven roller 20*b*. Specifically, when passing through between the feed-in drive roller 20*a* and the feed-in driven roller 20*b*, an appropriate space (sheet interval) can be formed between the back edge of the preceding sheet P and the front edge of the subsequent sheet P1. Therefore, even when a plurality of sheets P are fed/conveyed continuously, all print data corresponding to each sheet P can be printed completely in the printing region 210. Specifically, in the printing region 210, the back edge of the preceding sheet P and the front edge of the subsequent sheet P1 do not overlap with each other, thus printing is not performed on the space between the both sheets. In the above case, when the back edge of the preceding sheet P is removed from the supply roller 7 and the conveyed by only the pair of feed-in rollers 20*a*, 20*b*, control is performed such that a supply process for the subsequent sheet P1 is started by the supply roller 7, whereby an effect is obtained in which the above sheet interval can be obtained more securely.

According to the present invention, as described above, in the configuration in which the sheets P which are stacked on the paper cassette 5 can be supplied to the sheet guide 9 one by one by the supply roller 7, and this supplied sheet P is conveyed to the printing region 210 by the pair of feed-in rollers 20*a*, 20*b*, the pair of feed-in rollers 20*a*, 20*b* is configured by the feed-in drive roller 20*a* driven by the LF motor 42 and the feed-in driven roller 20*b* pressurized by the feed-in drive roller 20*a*. Further, the power of the pair of feed-in rollers 20*a*, 20*b* sending the sheets is set larger than the sending power of the supply roller 7, and the circumferential speed of the feed-in drive roller 20*a* is set higher than the circumferential speed of the supply roller 7. Moreover, the control means is provided so that control is performed such that, when the print data for the subsequent sheet P1 exists, the feed-in roller 20*a* and the supply roller 7 are continuously rotary driven in the same direction. Therefore, the plurality of sheets P can be continuously and successively conveyed to the printing region 210 and printed continuously and successively, thus an effect is obtained in which the printing operation on the plurality of sheets P can be executed at high speed.

Further, the feed-in drive roller 20*a* and the supply roller 7 are configured so as to be rotary driven by the single drive motor (LF motor) 42, thus an effect is obtained in which a configuration for feeding and supplying the sheets can be made simple.

In the present embodiment, since the front end of the arm 6*a* is provided with the supply roller 7, drawing operation of the paper cassette 5 does not obstruct the supply roller 7. Further, when a piece of sheet is in contact with the feed-in dive roller 20*a* and the supply roller 7, the arm 6*a* is oscillated, whereby the supply roller 7 is prevented from obstructing the pair of feed-in rollers 20*a*, 20*b* sending the sheets.

Since the power transmission switching means 100 is provided, switching can be performed between an intermittent feeding operation for positioning the cut sheets one by one and sending them to the printing region 210, and a high-speed feeding operation for continuously and successively sending the plurality of cut sheets. The operation for this switching is executed using the movement of the carriage 13, thus excess mechanisms are not required.

(Second Embodiment)

Hereinafter, only the differences between the first embodiment and the second embodiment are described and the overlapping explanations are omitted.

Figure 23:
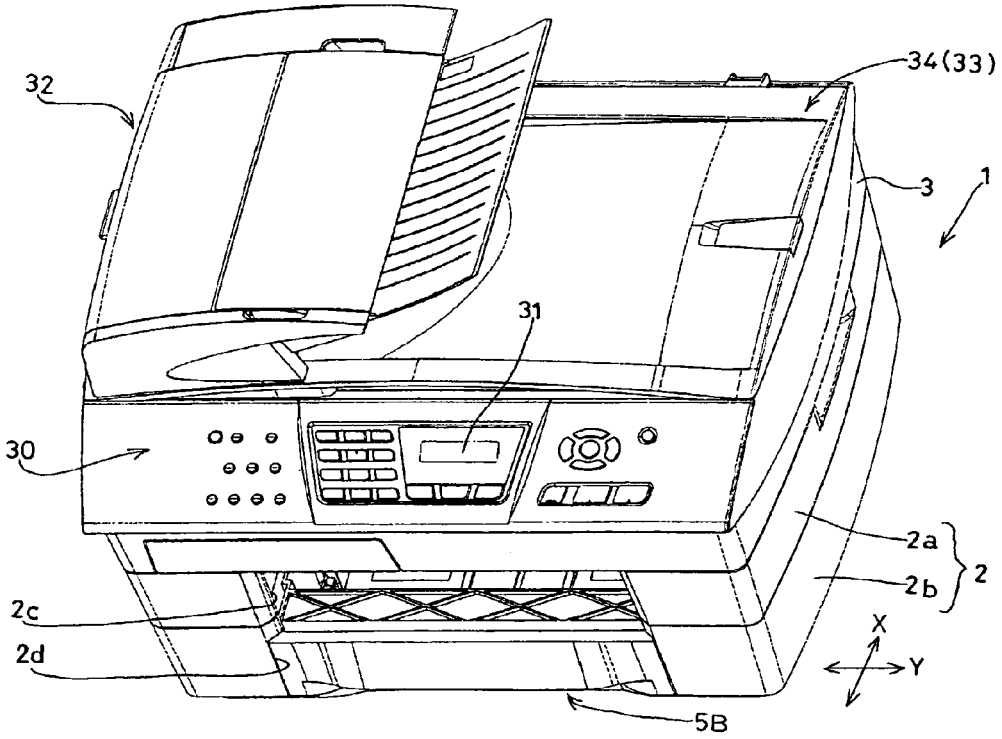
FIG. 23 is a perspective view of the entire multifunction device of a second embodiment.
Figure 24:
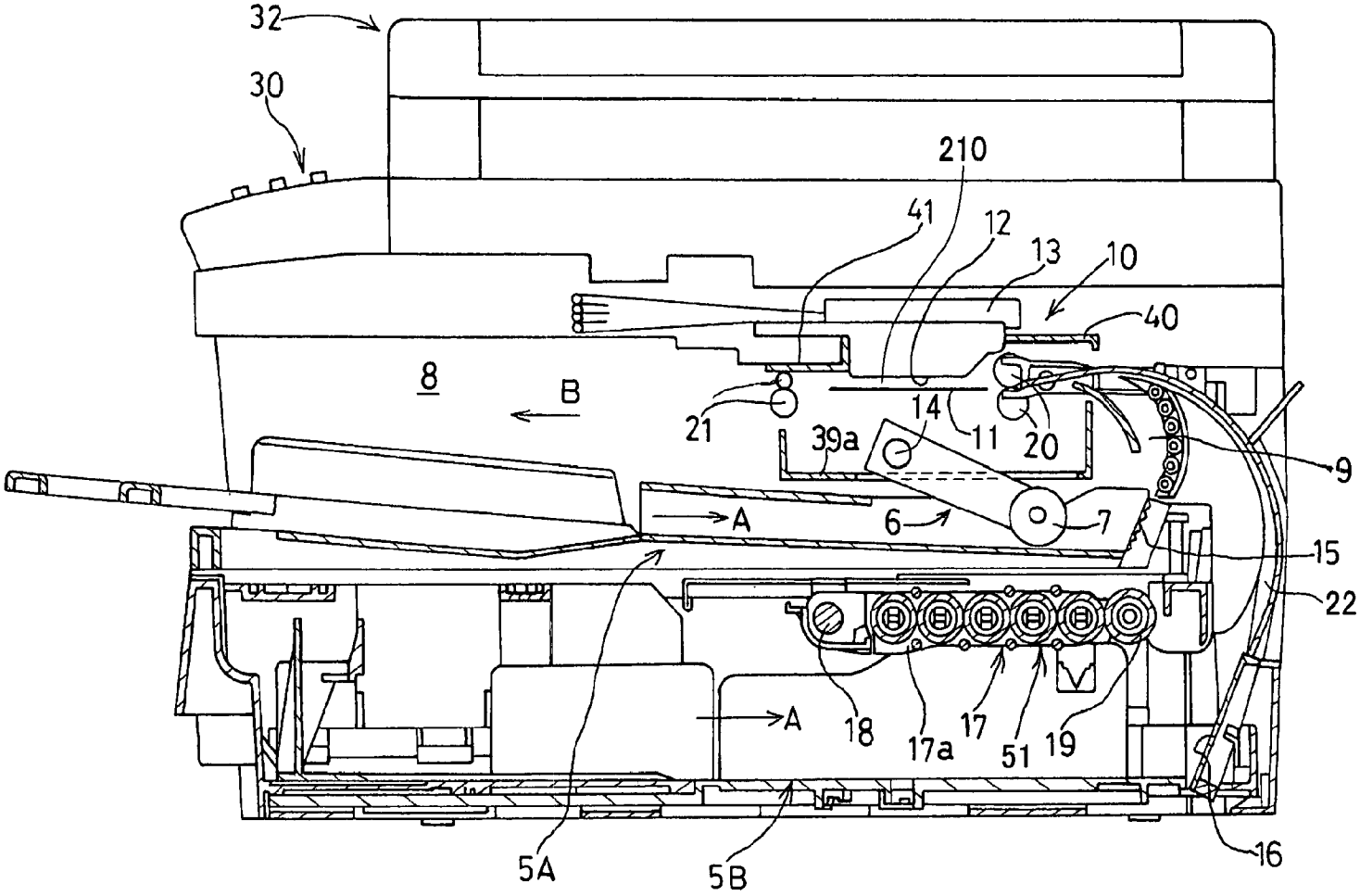
FIG. 24 is a cross-sectional view of a substantial part in which the paper cassette is installed in the multifunction device.

The multifunction device 1 in the second embodiment comprises, as shown in FIG. 23, the lower section case 2 in which a first lower section case 2*a* and a second lower section case 2*b* are stacked. An opening section 2*c* is formed on a front side of the first lower section case 2*a* and, as shown in FIG. 24, a first paper cassette 5A is inserted therein such that it can be drawn. As shown in FIG. 23, an opening section 2*d* is formed on a front side of the second lower section case 2*b* and, as shown in FIG. 24, a second paper cassette 5B is inserted therein such that it can be drawn.

FIG. 23 shows a state in which the first paper cassette 5A is removed from the lower section case 2 and the second paper cassette 5B is stored in the lower section case 2.

The upper section case 3 is disposed on an upper side of the lower section case 2. The upper section case 3 is provided with a script automatic sending device 32.

A discharge space is secured on a lower section of the operation panel section 30. The discharge space is configured with a space located higher than the paper cassette 5A in the opening section 2*c*.

As shown in FIG. 24, a first supply unit 6 having a first supply roller 7 is disposed on an upper section of the first paper cassette 5A. An U-shaped first conveying path 9 is disposed on a rear section of the first paper cassette 5A. Further, an inclined separating board 15 for separating sheets is disposed on a front side of the first paper cassette 5A. This inclined separating board 15 protrudes forward at a center in a width direction (Y-axis direction) of a sheet P, and is formed into a convex shape so as to step backward as it approaches right and left end sections in the width direction of the sheet P. Further, a central section in the width direction of the sheet P is provided with a saw-like elastic separating pad (not shown) which abuts on the front edge of the sheet P and promotes separation of the sheet P.

An upper end section of the arm 6*a* of the first supply unit 6 is swingably installed on the bottom surface 39*a* of the frame 39 in a vertical direction, and the supply roller 7 is provided at a lower end (free end section) of the arm 6*a*. One uppermost sheet of a plurality of sheets stacked on the first paper cassette 5A is taken out from the first paper cassette 5A and sent to the first conveying path 9 by a cooperation between the supply roller 7 and the elastic separating pad of the inclined separating board 15.

As shown in FIG. 24, the second paper cassette 5B is disposed in a lower section of the first paper cassette 5A. A front side of the second paper cassette 5B is also provided with an inclined separating board 16 having an elastic separation pad for separating sheets, the inclined separating board 16 having the configuration same as that in the first paper cassette 5A. An upper end of an arm 17*a* of a second supply unit 17 is installed in the second lower section case 2*b* so as to be able to swing around a drive shaft 18 in the vertical direction. A train 51 of a plurality of mating gears for transmitting a torque from the drive shaft 18 to a second supply roller 19 disposed on a front end of the arm 17*a* is disposed on the arm 17*a*.

A second conveying path 22 is formed astride the first lower section case 2*a* and the second lower section case 2*b*. One uppermost sheet of a plurality of sheets stacked on the second paper cassette 5B is taken out from the second paper cassette 5B and sent to the second conveying path 22 by a cooperation between the second supply roller 19 and the elastic separating pad of the inclined separating board 16.

The sheet which is sent to the first conveying path 9 and the sheet which is sent to the second conveying path 22 are both sent to a space between a pair of feed-in rollers 20 and further sent to the printing region 210 between a lower surface of the printing head 12 and the platen 11.

Figure 25:
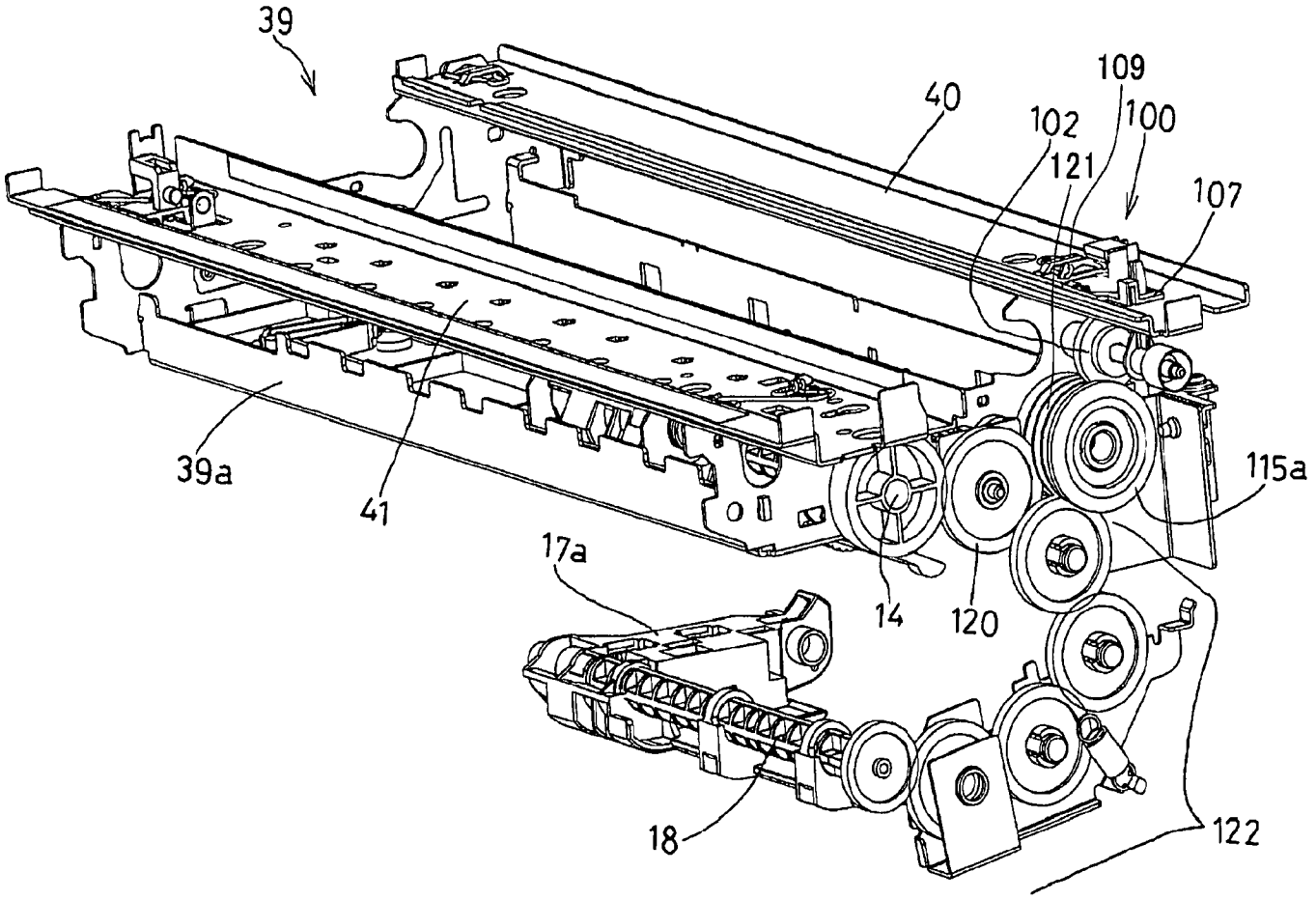
FIG. 25 is a perspective view of the power transmission switching means and a power transmission mechanism for a second supply unit.
Figure 26:
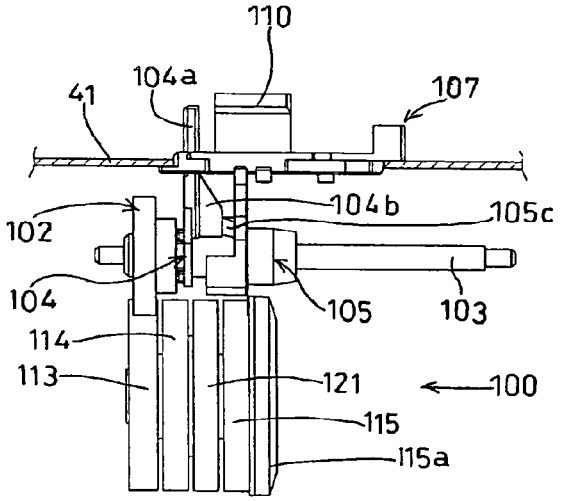
FIG. 26 is a front view showing power transmission in the intermittent feeding mode (first mode) when a sheet is fed.
Figure 27:
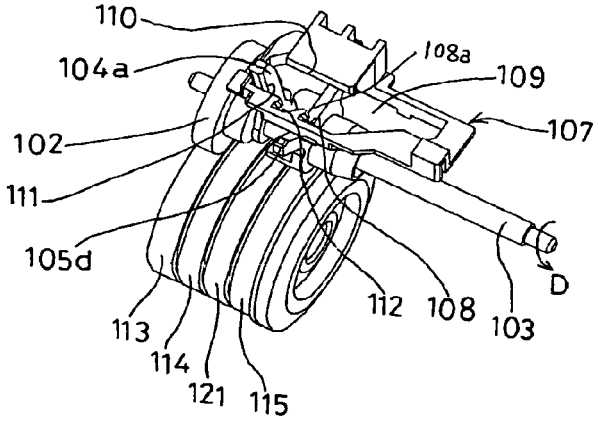
FIG. 27 is a perspective view showing power transmission in the intermittent feeding mode (first mode) when a sheet is fed.
Figure 28:
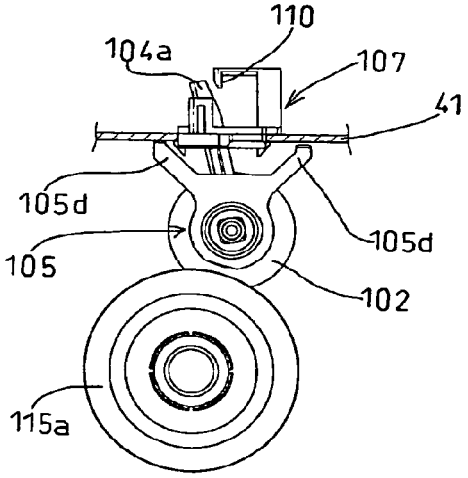
FIG. 28 is a side view showing power transmission in the intermittent feeding mode (first mode) when a sheet is fed.
Figure 29:
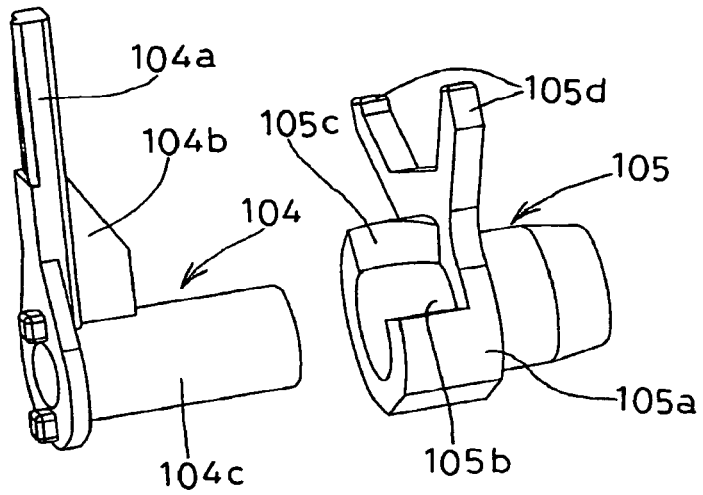
FIG. 29 is a perspective view of a first slider (first block) and a second slider (second block)

In the second embodiment, as shown in FIG. 25, a torque from the LF motor 42 is selectively transmitted from a right end section of the feed-in drive roller 20*a* via the power transmission switching means 100 to any of the first supply roller 7 of the first supply unit 6, the second supply roller 19 of the second supply unit 17, and the maintaining mechanism 36.

Next, a configuration of the power transmission switching means 100 is explained with reference to FIG. 25 through FIG. 44. The power transmission switching means 100 selects any of an intermittent feeding mode of an upper cassette, a continuous feeding mode of the upper cassette, a continuous feeding mode of a lower cassette, and a maintenance mode. In the intermittent feeding mode of the upper cassette, when the LF motor 42 rotates in the reverse direction the supply roller 7 is rotated in the forward direction. In the continuous feeding mode of the upper cassette, when the LF motor 42 rotates in the forward direction the supply roller 7 is rotated in the forward direction. In the continuous feeding mode of the lower cassette, when the LF motor 42 rotates in the forward direction the second supply roller 19 is rotated in the forward direction. In the maintenance mode the torque of the LF motor 42 is transmitted to the maintaining mechanism 36.

In the intermittent feeding mode of the upper cassette, when the LF motor 42 rotates in the reverse direction, the feed-in drive roller 20*a* rotates in a direction of returning a sheet to the sheet guide 9, and the first supply roller 7 rotates in a direction of taking the sheet out from the upper cassette 5A and sending it to the sheet guide 9. Thereafter, the LF motor 42 rotates in the forward direction, the feed-in drive roller 20*a* rotates in a direction of sending the sheet toward the printing region 210, and the first supply roller 7 rotates in a direction of returning the sheet to the upper cassette 5A.

In the continuous feeding mode of the upper cassette, the LF motor 42 rotates in the forward direction, the feed-in drive roller 20*a* rotates in a direction of sending the sheet toward the printing region 210, and the first supply roller 7 rotates in a direction of taking the sheet out from the upper cassette 5A and sending the sheet toward the sheet guide 9.

In the continuous feeding mode of the lower cassette, the LF motor 42 rotates in the forward direction, the feed-in drive roller 20*a* rotates in a direction of sending the sheet toward the printing region 210, and the second supply roller 19 rotates in a direction of taking the sheet out from the lower cassette 5B and sending the sheet toward the sheet guide 22.

As long as the modes are not switched by the power transmission switching means 100, the selected mode is maintained.

As described in the first embodiment, the torque from the LF motor 42 is transmitted to the feed-in drive roller 20*a*. A right end section of the feed-in drive roller 20*a* (upper section of the maintaining mechanism 36) is provided with a long gear 101 (see FIG. 42) configuring the power transmission switching means 100. A position adjacent to the gear 101 is provided with the switching gear 102 which is always engaged with the gear 101. The switching gear 102 is slidable with respect to the spindle 103 extending in the Y-axis direction.

Figure 44:
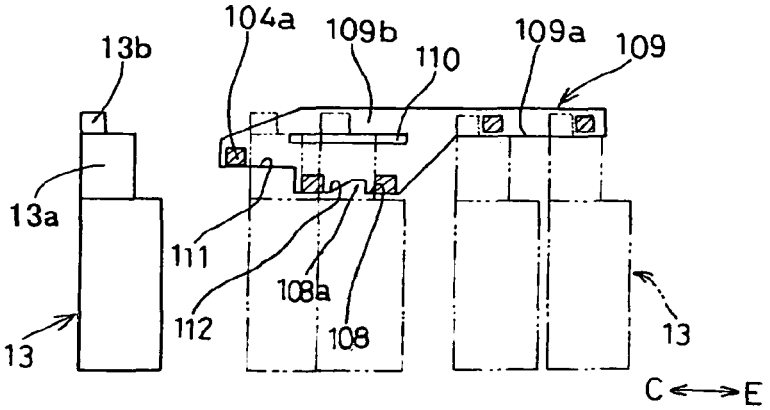
FIG. 44 is a plan view showing a state in which the modes are switched by the power transmission switching means.

As shown in FIG. 44, when the carriage 13 is located at a position facing a sheet P, the carriage 13 is separated from the maintaining mechanism 36, thus the carriage 13 does not press the abutting piece 104*a* in the direction of the arrow E. In this state, the first biasing force 106*a* causes the second block 105, the first block 104 and the switching gear 102 to slide in the direction of the arrow C along the spindle 103. The abutting piece 104*a* is positioned at the first set section 111. This position is called "position 1" (Po1). At this moment, the switching gear 102 is engaged with the intermittent feeding gear 113 of the upper cassette.

Figure 42:
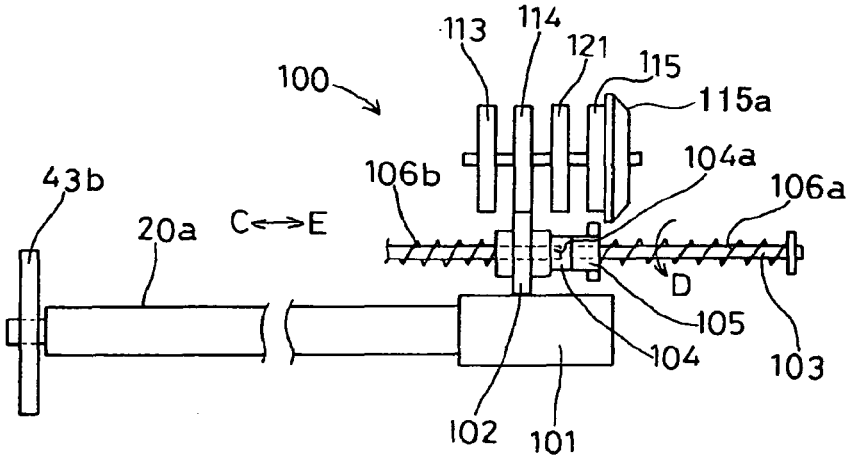
FIG. 42 is a schematic diagram showing the power transmission switching means.
Figure 43:
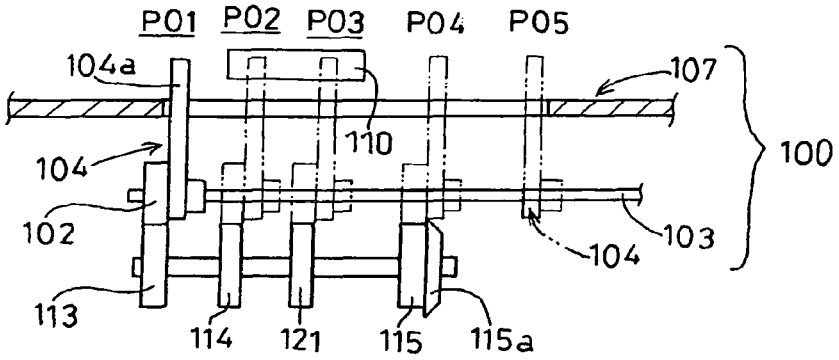
FIG. 43 is a front view schematically showing a state in which the modes are switched by the power transmission switching means.

When the carriage 13 moves in the direction of the arrow E, the first engaging step section 13*a* of the carriage 13 presses the abutting piece 104*a* in the direction of the arrow E. As a result, the switching gear 102, first block 104 and second block 105 slide in the direction of the arrow E along the spindle 103. The position where the carriage 13 is positioned at the second set section 112 of the abutting section 104*a* is called "position 2" (Po2). In the case of the position 2, the switching gear 102 is engaged with the continuous feeding gear 114 of the upper cassette. This state is shown in FIG. 42.

When the carriage 13 further moves in the direction of the arrow E, the first engaging step section 13*a* of the carriage 13 presses the abutting piece 104*a* in the direction of the arrow E. The pressed abutting piece 104*a* climbs over a convex section 108*a* and reaches the position 3 (Po3). In the case of the position 3, the switching gear 102 is engaged with a continuous feeding gear 121 of the lower cassette.

When the carriage 13 further moves in the direction of the arrow E, the first engaging step section 13*a* of the carriage 13 presses the abutting piece 104*a* in the direction of the arrow E. The pressed abutting piece 104*a* proceeds to the horizontal groove section 109*a* from the inclined groove section 109*b*. Once the abutting piece 104*a* enters the horizontal groove section 109*a*, the second engaging step section 13*b* of the carriage 13 presses the abutting piece 104*a*. When the abutting piece 104*a* is in the position immediately after entering the horizontal groove section 109*a* (this position is called "position 4" (Po4)), the switching gear 102 is engaged with the maintenance gear 115.

The switching gear 102, intermittent feeding gear 113, continuous feeding gear 114 and maintenance gear 115 are all spur gears, and the bevel gear 115*a* having a large diameter is fixed to a side surface of the maintenance gear 115. When the carriage 13 further moves from the position 4 (Po4) in the direction of the arrow E, a side surface of the switching gear 102 abuts on the bevel gear 115*a*, whereby the switching gear 102 is inhibited from moving any further in the direction of the arrow E and thus continues to be engaged with the maintenance gear 115. The abutting piece 104*a* is pressed by the second engaging step section 13*b* of the carriage 13 and then positioned at a back end section of the horizontal groove section 109*a* (right end section shown in FIG. 44 and FIG. 43). This position is called "position 5" (Po5) and is a home position (original position). In this state, the switching gear 102 and the first block 104 are separated from each other.

Contrary to the above state, when the carriage position 13 moves from the position 5 (Po5) in the direction of the arrow C, the abutting piece 104*a* moves from the horizontal groove section 109*a* to the inclined groove section 109*b*. At this moment, the abutting piece 104*a* is received by a step between the first engaging step section 13*a* and the second engaging step section 13*b* of the carriage 13, thus the abutting piece 104*a* moves above the regulating piece 110 of FIG. 44 in the direction of the arrow C. The abutting piece 104*a* abuts on a left inclined surface of the inclining groove section 109*b* shown in FIG. 44 while sliding on the regulating piece 110, thereafter moves to the left inclined surface and then is engaged with the first set section 111. After the carriage 13 moves to the position 5 in the E direction and then moves in the C direction, the abutting piece 104*a* moves from the position 1 to the position 2, from the position 2 to the position 3, from the position 3 to the position 4, from the position 4 to the position 5, and from the position 5 to the position 1. The carriage 13 repeats the movement of moving to the right end in the E direction and then moving in the C direction, while the abutting piece 104*a* repeats the cycle of moving from the position 1→2→3→4→5→1.

When the carriage 13 moves in the E direction to the position 1 and then moves in the C direction, the switching gear 102 is held at the position 1. When the carriage position 13 moves to the position 2 in the E direction and then moves in the C direction, the switching gear 102 is held in the position 2. When the carriage 13 moves in the E direction to the position 3 and then moves in the C direction, the switching gear 102 is held at the position 3.

At the position 1 (Po1) where the switching gear 102 is engaged with the intermittent feeding gear 113 of the upper cassette, the same phenomena as in the first embodiment are obtained.

At the position 2 (Po2) where the switching gear 102 is engaged with the continuous feeding gear 114 of the upper cassette, the same phenomena as in the first embodiment are obtained.

At the position 3 (Po3) where the switching gear 102 is engaged with the continuous feeding gear 121 of the lower cassette, rotation of the feed-in drive roller 20*a* is transmitted to the drive shaft 18 of the second supply unit 17 via a gear train 122 having a plurality of gears, as shown in FIG. 25. In this state, the LF motor 42 rotates in the forward direction, the feed-in drive roller 20*a* rotates in a direction of sending a sheet toward the printing region 210, and the second supply unit 19 rotates in a direction of taking the sheet out from the lower cassette 5B and sending the sheet toward the sheet guide 22.

At the position 4 (Po4) where the switching gear 102 is engaged with the maintenance gear 115, the same phenomena as in the case of the position 3 (Po3 ) in the first embodiment are obtained.

The power transmission switching means 100 of the present embodiment comprises: a plurality of drive power transmission sections (intermittent feeding gear 113 of the upper cassette, the continuous feeding gear 114 of the upper cassette, the continuous feeding gear 121 of the lower cassette, and the maintenance gear 115); the switching gear 102, which is a switching section for causing the carriage 13 to alternatively transmit power from the drive gear 101, which is a drive output section, to the drive power transmitting section, in accordance with the position of movement along the main scanning direction; and the position holding means (first, second, third set sections 111, 112, 108) for holding the position of movement along the main scanning direction of the switching gear 102. The switching gear 102 is biased along the main scanning direction from both directions, the switching gear 102 is moved and selectively engaged with one of the plurality of drive power transmission sections by simply moving the carriage 13 in the main scanning direction. Further, in the present invention, the position holding means exists every selected engaging section between the switching gear 102 and the drive power transmission section. Therefore, even if the carriage 13 separates from the switching gear 102 and moves to the image recording region, the above engagement, i.e. the power transmission state, can be held. As a result, even in either the continuous feeding operation or intermittent feeding operation, the drive power transmission state is selected, thus an effect is obtained in which the time required in operations for moving the carriage 13 and the like is reduced and the image recording operation can be performed at high speed and efficiently.

In the intermittent feeding mode, switching is performed between a state in which the supply roller 7 is rotated in the forward direction and the feed-in drive roller 20*a* is rotated in the reverse direction, and a state in which the supply roller 7 is rotated in the reverse direction and the feed-in drive roller 20*a* is rotated in the forward direction. In the continuous feeding mode, the feed-in drive roller 20*a* and the supply roller 7 are continuously rotary driven in the same direction. In either mode, even when the carriage 13 returns to the image recording region, the power transmission switching means 100 is held in the selected mode, thus it is not necessary to move the carriage and select a mode every time one sheet is printed. When executing the intermittent feeding mode using a conventional technology, it is necessary to move the carriage 13 to operate the power transmission switching means 100 every time when the position of a sheet is aligned using the feed-in roller which is rotated in the reverse direction. In the present embodiment as well, such an operation is required and effective printing can be executed.

Moreover, the pair of feed-in rollers 20*a*, 20*b* is disposed on an upstream side of a conveying direction of a sheet P, which is higher than the carriage 13, the first supply roller 7 and the second supply roller 19 are disposed on the further upstream side, and these components are rotated by a single LF motor 42, thus an effect is obtained in which the configuration of feeding/conveying the sheet can be made simple.

The present invention is not limited to the embodiments explained by the above descriptions and the figures, and thus can be changed and implemented in various ways without departing from the scope of the principles of the present invention. For example, the paper cassette may be disposed to configure a plurality of steps (at least three steps), whereby a plurality of operation modes such as the above continuous feeding operation and intermittent feeding operation may be executed when feeding sheets for each step. The number of position holding sections provided in the power transmission switching means 100 may be increased.

Moreover, one paper cassette may be provided and an operation mode may be selected from at least three modes. The position holding section corresponding to each operation mode may be provided. In the above case as well, an operation mode for performing a maintenance work may be added.

The present invention is not limited to the embodiments explained by the above descriptions and the figures, and thus can be changed and implemented in various ways without departing from the scope of the principles of the present invention. For example, the paper cassette may be disposed to configure a plurality of steps, whereby the above continuous feeding operation may be executed when feeding sheets for each step.

What is claimed is:

1. A printer comprising:

a printing head;

a carriage mounting the printing head, the carriage being movable between an end of a first side and an end of a second side of a reciprocating path extending along a direction; and a driving force transmitting path selecting mechanism provided at the second side, wherein the driving force transmitting path selecting mechanism comprises:

a common driving force outputting member;

a plurality of driving force receiving members;

a selecting member that connects the common driving force outputting member to one of the plurality of driving force receiving members, wherein the selecting member moves from a default position to a first selected position when the carriage moves to a first carriage position in a predetermined region of the second side, and the selecting member connects the common driving force outputting member to a first driving force receiving member among the plurality of driving force receiving members when the selecting member is located at the default position and connects the common driving force outputting member to a second driving force receiving member among the plurality of driving force receiving members when the selecting member is located at the first selected position; and a position retainer that retains the selecting member at the first selected position when the carriage is positioned outside the predetermined region after the carriage has moved to the first carriage position in the predetermined region in order to move the selecting member to the first selected position, wherein the selecting member returns from the first selected position to the default position when the carriage is positioned outside the predetermined region after the carriage has moved to a reset position in the predetermined region, the reset position being closer to the end of the second side of the reciprocating path than the first carriage position.

2. The printer as in claim 1, wherein the selecting member moves from the first selected position to a second selected position when the carriage moves to a second carriage position in the predetermined region, the second carriage position being closer to the end of the second side of the reciprocating path than the first carriage position, and the selecting member connects the common driving force outputting member to a third driving force receiving member among the plurality of driving force receiving members when the selecting member is located at the second selected position.

3. The printer as in claim 2, wherein the selecting member moves from the second selected position to the default position and then moves from the default position to the first selected position, when the carriage moves to the reset position, then moves outside the predetermined region, and then moves to the first carriage position, the reset position being closer to the end of the second side of the reciprocating path than the second carriage position.

4. The printer as in claim 2, wherein the default position, the first selected position, the second selected position, and the reset position are arranged in an order of the default position, the first selected position, the second selected position, and the reset position from the first side toward the second side.

5. The printer as in claim 1, wherein the position retainer comprises a receiving portion that receives the selecting member by contacting the selecting member, the receiving portion retaining the selecting member at the first selected position when the carriage is positioned outside the predetermined region after the carriage has moved to the first carriage position in the predetermined region.

6. The printer as in claim 1, wherein the plurality of driving force receiving members is aligned in a line.

7. The printer as in claim 1, wherein the selecting member moves linearly.

8. The printer as in claim 1, wherein the selecting member comprises a spur gear that meshes with the common driving force outputting member.

9. The printer as in claim 8, wherein the spur gear further meshes selectively with each of the plurality of driving force receiving members.

10. The printer as in claim 1, wherein the position retainer comprises a guide groove that guides the selecting member.

11. The printer as in claim 10, wherein the selecting member comprises a specific member that moves within the guide groove, and the position retainer comprises a receiving portion that receives the specific member by contacting the specific member, and a bias member that bases the specific member such that the specific member contacts the receiving portion.

12. The printer as in claim 10, wherein the guide groove includes a first route that guides the selecting member and a second route that guides the selecting member, the second route being different from the first route, the selecting member is guided along the first route in a case where the selecting member moves from the default position to the first position, and the selecting member is guided along the second route in a case where the selecting member moves from the first position via the reset position to the default position.

13. The printer as in claim 1, wherein the default position, the first selected position, and the reset position are arranged in an order of the default position, the first selected position, and the reset position from the first side toward the second side.

* * * * *